US012479547B2

(12) United States Patent
Hara et al.

(10) Patent No.: US 12,479,547 B2
(45) Date of Patent: Nov. 25, 2025

(54) SHIP MANEUVERING DEVICE AND SHIP

(71) Applicant: Yanmar Holdings Co., Ltd., Osaka (JP)

(72) Inventors: Naohiro Hara, Osaka (JP); Tomoya Fukukawa, Osaka (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 255 days.

(21) Appl. No.: 18/281,179

(22) PCT Filed: Mar. 8, 2022

(86) PCT No.: PCT/JP2022/010024
§ 371 (c)(1),
(2) Date: Sep. 8, 2023

(87) PCT Pub. No.: WO2022/191191
PCT Pub. Date: Sep. 15, 2022

(65) Prior Publication Data

US 2024/0174331 A1 May 30, 2024

(30) Foreign Application Priority Data

Mar. 12, 2021 (JP) ..... 2021-040258

(51) Int. Cl.
*B63H 25/04* (2006.01)
*B63B 79/40* (2020.01)
*B63H 21/21* (2006.01)

(52) U.S. Cl.
CPC ..... *B63B 79/40* (2020.01); *B63H 21/21* (2013.01); *B63H 25/04* (2013.01); *B63H 2021/216* (2013.01)

(58) Field of Classification Search
CPC ..... B63H 21/21; B63H 25/04; B63H 25/42; B63H 2021/216; B63B 79/40
See application file for complete search history.

(56) References Cited

U.S. PATENT DOCUMENTS 4,129,087 A 12/1978 Dimmick et al.
11,505,300 B1 * 11/2022 Yamaguchi ..... B63H 20/12
(Continued)

FOREIGN PATENT DOCUMENTS

EP 3763618 A1 6/2020
JP S584698 A 1/1983
(Continued)

OTHER PUBLICATIONS

Piao et al., Maneuvering mathematical model and course control of POD-driven ship, 2016, IEEE, p. 301-305 (Year: 2016).*
(Continued)

*Primary Examiner* — Mcdieunel Marc
(74) *Attorney, Agent, or Firm* — NORTON ROSE FULBRIGHT US LLP

(57) ABSTRACT

This ship maneuvering device causes a ship having at least one propulsion device mounted thereon to travel along a scheduled course. The ship maneuvering device is provided with a control unit. The control unit acquires an azimuth deviation between an actual bow azimuth, which is the current bow azimuth of the ship, and a target bow azimuth of the ship, and, on the basis of the azimuth deviation, generates a thrust command that indicates the thrust with which the ship is to be propelled. In the case where the azimuth deviation is equal to or greater than a prescribed value, the control unit generates a thrust command such that causes the speed of the ship is reduced below an actual speed which is the current speed of the ship.

12 Claims, 21 Drawing Sheets

(56) References Cited

U.S. PATENT DOCUMENTS

| | | | | |
|---|---|---|---|---|
| 11,987,340 | B2 * | 5/2024 | Kadota | G05D 1/2435 |
| 2010/0002536 | A1 * | 1/2010 | Brewer | G01V 1/3817 367/16 |
| 2019/0302774 | A1 | 10/2019 | Akkuzawa et al. | |

FOREIGN PATENT DOCUMENTS

| | | | |
|---|---|---|---|
| JP | H08198185 | A | 8/1996 |
| JP | 2014-129047 | A | 7/2014 |
| JP | 2017088111 | A | 5/2017 |

OTHER PUBLICATIONS

Zaman et al., Design of Ship Model Dynamic Positioning System using PID-Based Microcontroller, 2019, IEEE, p. 49-56 (Year: 2019).*

Skulstad et al., A Hybrid Approach to Motion Prediction for Ship Docking-Integration of a Neural Network Model Into the Ship Dynamic Model, 2020, IEEE, p. 1-11 (Year: 2020).*

Veksler et al., Dynamic Positioning With Model Predictive Control, 2016, IEEE, p. 1340-1353 (Year: 2016).*

International Search Report dated May 17, 2022 issued in corresponding PCT Application PCT/JP2022/010024.

The Extended European Search Report dated Feb. 17, 2025, issued in EP Application No. 22767145.0.

* cited by examiner (a)

(b)

(c)

(a)

(b)

(c)

(a)

(b)

(c)

SHIP MANEUVERING DEVICE AND SHIP

CROSS-REFERENCE TO RELATED APPLICATIONS

This application is a national stage application pursuant to 35 U.S.C. § 371 of International Application No. PCT/JP2022/010024, filed on Mar. 8, 2022, which claims priority under 35 U.S.C. § 119 to Japanese Patent Application No. 2021-040258 filed on Mar. 12, 2021, the disclosures of which are hereby incorporated by reference in their entireties.

TECHNICAL FIELD

The present invention relates to a ship maneuvering device and a ship.

BACKGROUND ART

A ship equipped with an autopilot system has been known (see, for example, Patent Document 1). The autopilot system is a system for causing a ship to follow a scheduled course. The scheduled course is a preset course.

An automatic ship steering device of Patent Document 1 includes a computing unit. The automatic ship steering device supplies a deviation between an azimuth angle signal from a gyro compass and an azimuth setting signal from a course setter to the computing unit, and drives a steering device according to the output of the computing unit. The automatic ship steering device causes a ship to follow a scheduled course by operating a rudder. As described above, the automatic ship steering device of Patent Document 1 operates the rudder to control movement of the ship in the lateral direction.

PRIOR ART DOCUMENT

Patent Document

Patent Document 1: JP-A-58-4698

SUMMARY OF INVENTION

Technical Problem

However, the automatic ship steering device does not control thrust in the front-back direction of the ship. Thus, control of movement of the ship in the lateral direction and control of movement of the ship in the front-back direction are performed independently. As a result, a turning radius at the time of changing the course of the ship is increased. For this reason, for example, in a case where a course change position at which the course greatly changes is included in the scheduled course, there is a probability that overshoot of the ship from the scheduled course occurs at the course change position.

The present invention has been made in view of the above-described problems, and an object thereof is to provide a ship maneuvering device and a ship capable of decreasing a turning radius when the course of the ship is changed.

Solution to Problem

In the present invention, the ship maneuvering device moves a ship equipped with at least one propulsion device along a scheduled course. The ship maneuvering device includes a control unit. The control unit acquires an azimuth deviation between an actual bow azimuth which is the current bow azimuth of the ship and a target bow azimuth of the ship, and generates a thrust command indicating thrust for propelling the ship based on the azimuth deviation. In a case where the azimuth deviation is a predetermined value or more, the control unit generates the thrust command such that the speed of the ship decreases from an actual speed which is the current speed of the ship.

In the present invention, the ship includes the above-described ship maneuvering device and at least one propulsion device. The at least one propulsion device operates based on at least the thrust command.

Advantageous Effects of Invention

According to the ship maneuvering device and ship of the present invention, the turning radius can be decreased when the course of the ship is changed.

BRIEF DESCRIPTION OF DRAWINGS

FIG. 3(*b*) is a graph illustrating a relationship between the turning ratio and the degree of turning force; and FIG. 3(*c*) is a view illustrating movement of the ship according to the turning ratio;

FIG. 8(*b*) is a graph defining the relationship between the turning ratio and the degree of turning force; and FIG. 8(*c*) is a view illustrating movement of the ship according to the turning ratio;

FIG. 22(*b*) is a graph defining the relationship between the turning ratio and the degree of turning force when the operation amount of the electronic throttle lever is 0%; and FIG. 22(*c*) is a view schematically illustrating the operation amount of the electronic throttle lever;

FIG. 23(*b*) is a graph defining the relationship between the turning ratio and the degree of turning force when the operation amount of the electronic throttle lever is 50%; and FIG. 23(*c*) is a view schematically illustrating the operation amount of the electronic throttle lever; FIG. 24(*b*) is a graph defining the relationship between the turning ratio and the degree of turning force when the operation amount of the electronic throttle lever is 100%; and FIG. 24(*c*) is a view schematically illustrating the operation amount of the electronic throttle lever.

DESCRIPTION OF EMBODIMENTS

Hereinafter, embodiments of a ship maneuvering device and a ship of the present invention will be described with reference to the drawings. Note that the present invention is not limited to the following embodiments and can be implemented in various aspects without departing from the gist of the present invention. Description of overlapping contents may be omitted as necessary.

First Embodiment

Figure 1:
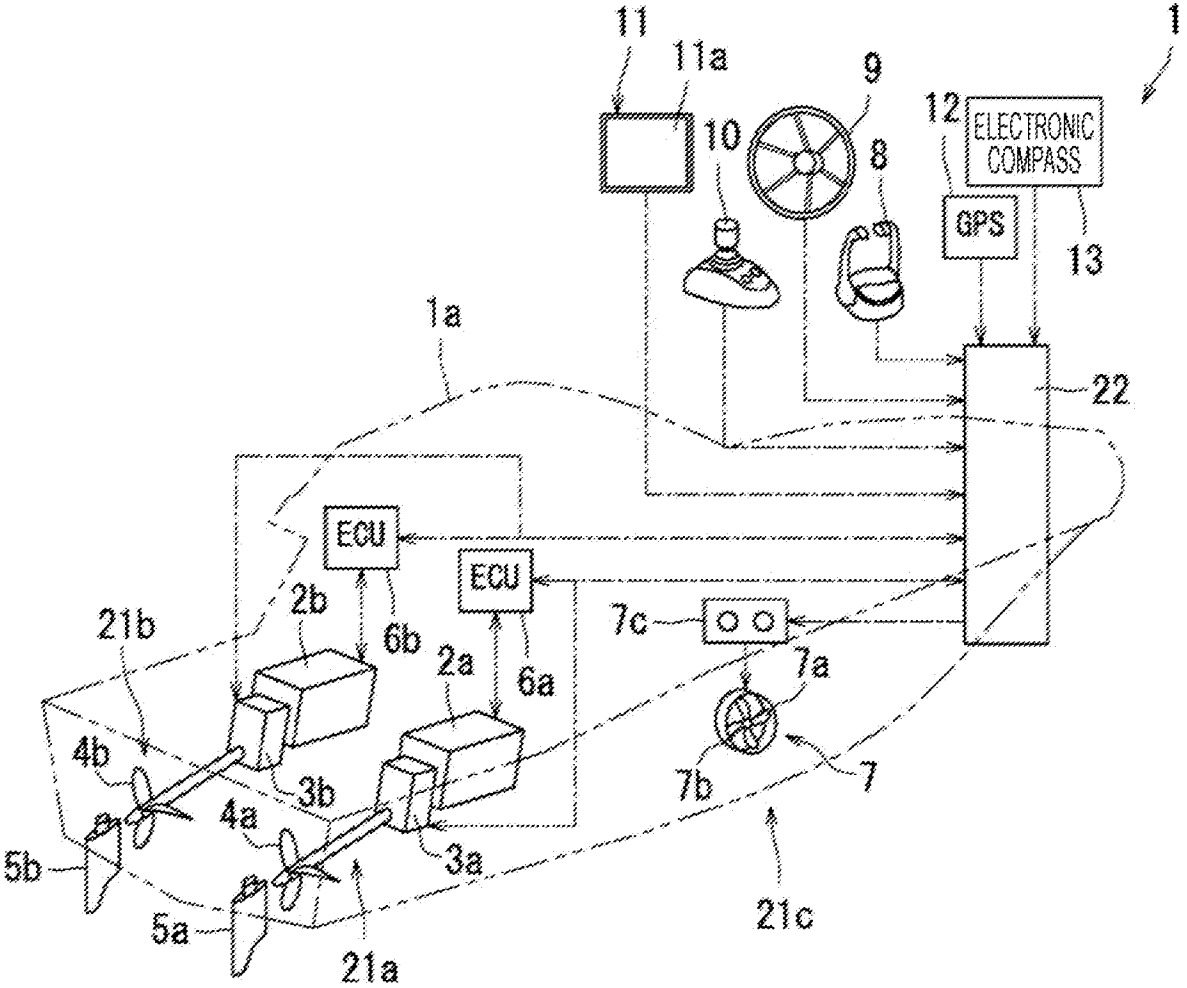
FIG. 1 is a view illustrating the configuration of a ship according to a first embodiment of the present invention.

Hereinafter, a first embodiment of the present invention will be described with reference to FIGS. 1 to 11. First, a ship 1 of the present embodiment will be described with reference to FIG. 1. FIG. 1 is a view illustrating the configuration of the ship 1 of the present embodiment.

The ship 1 includes a plurality of propulsion devices (first propulsion device 21*a*, second propulsion device 21*b*, and third propulsion device 21*c*). Specifically, the ship 1 is a twin-screw propulsion type shaft ship including one side thruster 7. Thus, in addition to movement to the bow side and movement to the stern side, the ship 1 can make oblique sailing and pivot turn. Note that movement to the bow side and movement to the stern side include turn. Oblique sailing indicates that the ship 1 moves to an arbitrary azimuth while maintaining the bow azimuth.

As illustrated in FIG. 1, the ship 1 includes a ship body 1*a*, an electronic throttle lever 8, an electronic steering wheel 9, a joystick lever 10, a route setting device 11, a global positioning system (GPS) device 12, an electronic compass 13, the first propulsion device 21*a*, the second propulsion device 21*b*, the third propulsion device 21*c*, and a control device 22. The electronic throttle lever 8, the electronic steering wheel 9, the joystick lever 10, the route setting device 11, the GPS device 12, the electronic compass 13, the first to third propulsion devices 21*a* to 21*c*, and the control device 22 are mounted on the ship body 1*a*.

The route setting device 11 is operated by a ship operator to set a scheduled course of the ship 1. In the present embodiment, the route setting device 11 has a touch display 11*a*. The route setting device 11 displays a chart on the touch display 11*a*. The ship operator can input a transit point on the scheduled course by performing touch operation on the touch display 11*a* displaying the chart. The route setting device 11 generates route information based on the position where the ship operator touches the touch display 11*a*. The route information indicates arrangement of a plurality of transit points as the scheduled course of the ship 1. The route setting device 11 outputs the route information to the control device 22.

The electronic throttle lever 8, the electronic steering wheel 9, and the joystick lever 10 are operation members for the ship operator to maneuver the ship 1. The ship operator operates the electronic throttle lever 8, the electronic steering wheel 9, and the joystick lever 10 to maneuver the ship 1.

The control device 22 has an automatic mode and a manual mode. When the automatic mode is valid, the control device 22 controls the first to third propulsion devices 21*a* to 21*c* such that the ship 1 follows the scheduled course. When the manual mode is valid, the control device 22 controls the first to third propulsion devices 21*a* to 21*c* according to operation of the electronic throttle lever 8, the electronic steering wheel 9, and the joystick lever 10 by the ship operator.

Note that in the present embodiment, the route setting device 11 receives the input of an instruction to start the automatic mode and the input of an instruction to stop the automatic mode. Thus, the ship operator can instruct the start and stop of the automatic mode by performing touch operation on the touch display 11*a* of the route setting device 11. When the instruction to start the automatic mode is input, the automatic mode is valid. When the instruction to stop the automatic mode is input, the automatic mode is no longer valid. When the automatic mode is not valid, the manual mode is valid.

Figure 2:
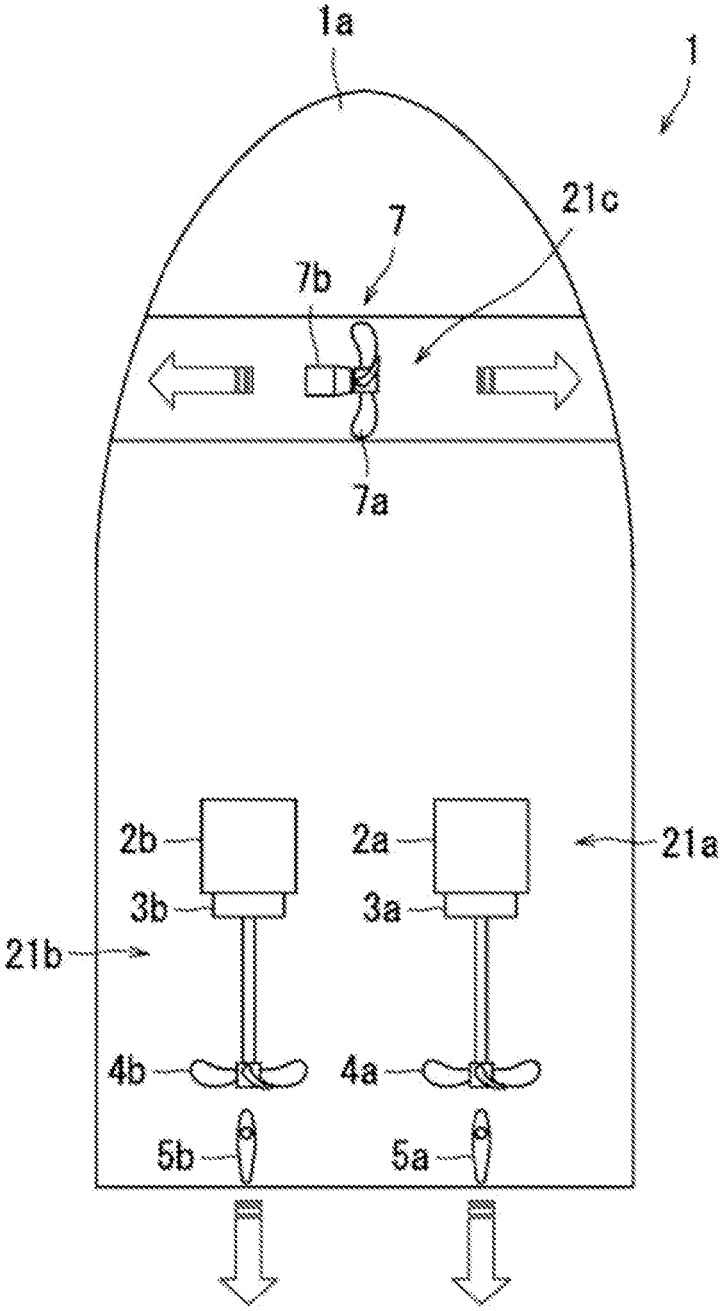
FIG. 2 is a view illustrating arrangement of forward-backward propellers, rudders, and a side thruster.

Subsequently, the ship 1 of the present embodiment will be further described with reference to FIGS. 1 and 2. FIG. 2 is a view illustrating arrangement of forward-backward propellers 4*a*, 4*b*, rudders 5*a*, 5*b*, and the side thruster 7. First, the first propulsion device 21*a* and the second propulsion device 21*b* will be described with reference to FIGS. 1 and 2.

As illustrated in FIGS. 1 and 2, the first propulsion device 21*a* includes an engine 2*a*, a switching clutch 3*a*, the forward-backward propeller 4*a*, the rudder 5*a*, and an electronic control unit (ECU) 6*a*. Similarly, the second propulsion device 21*b* includes an engine 2*b*, a switching clutch 3*b*, the forward-backward propeller 4*b*, the rudder 5*b*, and an ECU 6*b*.

The first propulsion device 21*a* and the second propulsion device 21*b* generate thrust for propelling the ship 1. Specifically, the first propulsion device 21*a* generates the thrust by rotating the forward-backward propeller 4*a*. The forward-backward propeller 4*a* is arranged on the starboard side of the ship body 1*a*. The second propulsion device 21*b* generates the thrust by rotating the forward-backward propeller 4*b*. The forward-backward propeller 4*b* is arranged on the port side of the ship body 1*a*. Hereinafter, the configuration of the first propulsion device 21*a* will be described.

The engine 2*a* generates power for rotating the forward-backward propeller 4*a*. An output shaft of the engine 2*a* is connected to the input side of the switching clutch 3*a*. A propeller shaft of the forward-backward propeller 4*a* is connected to the output side of the switching clutch 3*a*. When the power is transmitted from the output shaft of the engine 2*a* to the input side of the switching clutch 3*a*, the switching clutch 3*a* transmits the power from the engine 2*a* to the propeller shaft of the forward-backward propeller 4*a*. As a result, the forward-backward propeller 4*a* rotates.

The switching clutch 3*a* is controlled by the control device 22 to switch the power transmitted to the propeller shaft of the forward-backward propeller 4*a* between a forward rotation direction and a reverse rotation direction. Thus, the front-back direction of the thrust generated by the forward-backward propeller 4*a* is controlled by the control device 22. Note that the front-back direction includes a direction from the stern toward the bow and a direction from the bow toward the stern.

The propeller shaft of the forward-backward propeller 4*a* penetrates the bottom of the ship body 1*a*. A plurality of blades of the forward-backward propeller 4*a* are arranged outside the ship. The plurality of blades rotate about the propeller shaft as a rotation axis. The forward-backward propeller 4*a* rotates, and accordingly, the plurality of blades paddles water therearound to generate the thrust.

The ECU 6*a* stores various computer programs for controlling the engine 2*a* and various types of data. For example, the ECU 6*a* has a central processing unit (CPU), a read only memory (ROM), and a random access memory (RAM). The ECU 6*a* may have a large scale integration (LSI).

The ECU 6*a* controls the rotation speed of the engine 2*a* based on a command from the control device 22. Thus, the degree of thrust generated by the forward-backward propeller 4*a* is controlled by the control device 22.

The rudder 5*a* is arranged at the back of the forward-backward propeller 4*a*. The rudder 5*a* is rotatable in a predetermined angle range in the left-right direction about a rotary shaft provided in the ship body 1*a*. The rudder 5*a* controls the direction of water flow generated by rotation of the forward-backward propeller 4*a*.

The rudder angle of the rudder 5*a* is controlled by the control device 22. Thus, the left-right direction of the thrust generated by the forward-backward propeller 4*a* is controlled by the control device 22. For example, the ship 1 includes a hydraulic circuit for rotating the rudder 5*a*. In this case, the control device 22 controls the rudder angle of the rudder 5*a* via the hydraulic circuit.

The configuration of the first propulsion device 21*a* has been described above. Since the configuration of the second propulsion device 21*b* is substantially similar to that of the first propulsion device 21*a*, description thereof will be omitted.

Subsequently, the third propulsion device 21*c* will be described with reference to FIGS. 1 and 2. As illustrated in FIGS. 1 and 2, the third propulsion device 21*c* includes the side thruster 7 and a controller 7*c*.

The third propulsion device 21*c* generates thrust in the lateral direction (left-right direction). Specifically, the side thruster 7 generates the thrust in the lateral direction. The side thruster 7 is provided at the center in the left-right direction on the bow side of the ship body 1*a*. The side thruster 7 includes a propeller 7*a* and a motor 7*b*.

The controller 7*c* controls the rotation speed and rotation direction of the motor 7*b*. When the motor 7*b* rotates, the propeller 7*a* rotates to generate the thrust in the lateral direction.

The controller 7*c* controls the motor 7*b* based on a command from the control device 22. Thus, the degree and azimuth (thrust direction) of thrust generated by the propeller 7*a* are controlled by the control device 22.

Subsequently, the electronic throttle lever 8, the electronic steering wheel 9, the joystick lever 10, the GPS device 12, the electronic compass 13, and the control device 22 will be described with reference to FIG. 1.

The electronic throttle lever 8 has a right throttle lever and a left throttle lever. When the right throttle lever is operated by the ship operator, the electronic throttle lever 8 generates a signal instructing the rotation speed and rotation direction of the forward-backward propeller 4*a*. When the left throttle lever is operated by the ship operator, the electronic throttle lever 8 generates a signal instructing the rotation speed and rotation direction of the forward-backward propeller 4*b*.

Specifically, when the ship operator operates the right throttle lever, the electronic throttle lever 8 outputs, to the control device 22, a signal (or signal indicating an operation position) indicating the operation direction and operation amount of the right throttle lever by the ship operator. When the manual mode is valid, the control device 22 controls the rotation speed of the engine 2*a* and the switching state of the switching clutch 3*a* based on the signal output from the electronic throttle lever 8. Similarly, when the ship operator operates the left throttle lever, the electronic throttle lever 8 outputs, to the control device 22, a signal (or signal indicating an operation position) indicating the operation direction and operation amount of the left throttle lever by the ship operator. When the manual mode is valid, the control device 22 controls the rotation speed of the engine 2*b* and the switching state of the switching clutch 3*b* based on the signal output from the electronic throttle lever 8.

The electronic steering wheel 9 generates a signal instructing the rotation angles (rudder angles) of the rudders 5*a*, 5*b*. Specifically, when the ship operator operates the electronic steering wheel 9, the electronic steering wheel 9 outputs, to the control device 22, a signal (or signal indicating an operation position) indicating the operation direction and operation amount of the electronic steering wheel 9 by the ship operator. When the manual mode is valid, the control device 22 controls the rudder angles of the rudders 5*a*, 5*b* based on the signal output from the electronic steering wheel 9.

The joystick lever 10 generates a signal for moving the ship 1 in an arbitrary direction while maintaining the bow azimuth of the ship 1. Specifically, a lever of the joystick lever 10 can tilt in an arbitrary direction. When the ship operator tilts the lever of the joystick lever 10, the ship 1 moves in a direction in which the lever of the joystick lever 10 tilts.

Specifically, the joystick lever 10 outputs, to the control device 22, a signal indicating the tilting direction (operation direction by the ship operator) and tilting amount (operation amount by the ship operator) of the lever. When the manual mode is valid, the control device 22 controls the first to third propulsion devices 21*a* to 21*c* based on the signal output from the joystick lever 10. Specifically, the control device 22 controls the rotation speeds of the engines 2*a*, 2*b*, the switching states of the switching clutches 3*a*, 3*b*, the rudder angles of the rudders 5*a*, 5*b*, and the rotation speed and rotation direction of the motor 7*b* such that the ship 1 moves in the tilting direction of the lever with the thrust according to the tilting amount of the lever.

The joystick lever 10 also generates a signal for pivotally turning the ship 1. Specifically, the lever of the joystick lever 10 is rotatable about a lever shaft. When the ship operator rotates the lever of the joystick lever 10, the ship 1 pivotally turns in the direction in which the lever of the joystick lever 10 rotates.

Specifically, the joystick lever 10 outputs, to the control device 22, a signal indicating the rotation direction (operation direction by the ship operator) and rotation amount (operation amount by the ship operator) of the lever. When the manual mode is valid, the control device 22 controls the first to third propulsion devices 21*a* to 21*c* based on the signal output from the joystick lever 10. Specifically, the control device 22 controls the rotation speeds of the engines 2*a*, 2*b*, the switching states of the switching clutches 3*a*, 3*b*, the rudder angles of the rudders 5*a*, 5*b*, and the rotation speed and rotation direction of the motor 7*b* such that the ship 1 pivotally turns in the rotation direction of the lever with the thrust according to the rotation amount of the lever.

The GPS device 12 measures (calculates) the position coordinates of the ship 1 by receiving signals from a plurality of GPS satellites, and outputs, to the control device 22, a signal indicating the current position of the ship 1 by the latitude and the longitude. That is, the GPS device 12 calculates the absolute value of the position coordinates of the ship 1.

The electronic compass 13 is one example of an azimuth sensor. The electronic compass 13 measures (calculates) the bow azimuth of the ship 1 from geomagnetism. That is, the electronic compass 13 calculates the absolute azimuth of the bow of the ship 1. The electronic compass 13 outputs a signal indicating the bow azimuth to the control device 22.

When the automatic mode is valid, the control device 22 controls the first to third propulsion devices 21*a* to 21*c* such that the ship 1 follows the scheduled course, based on position information acquired from the GPS device 12 and azimuth information acquired from the electronic compass 13. Specifically, the control device 22 controls the degree of forward thrust, the degree of turning force, and a turning direction. Here, the forward thrust indicates force for propelling the ship 1 to the bow azimuth. The turning force indicates the moment of force for turning the ship 1.

Note that the position information acquired from the GPS device 12 indicates the current position of the ship 1. Specifically, the position information indicates the current position of the ship 1 by the latitude and the longitude. The azimuth information acquired from the electronic compass 13 indicates the current bow azimuth of the ship 1. Hereinafter, the current bow azimuth of the ship 1 may be referred to as an "actual bow azimuth."

When the automatic mode is valid, the control device 22 acquires a target bow azimuth from the route information (information indicating arrangement of the plurality of transit points) and the position information, and controls the forward thrust and the turning force based on an azimuth deviation between the target bow azimuth and the actual bow azimuth. Further, in a case where the azimuth deviation is a predetermined value or more, the control device 22 controls the forward thrust such that the speed of the ship 1 decreases from a current speed. Accordingly, when the azimuth deviation reaches the predetermined value or more at a scheduled course change position, the speed of the ship 1 decreases.

According to the present embodiment, when the course of the ship 1 is changed, in a case where the azimuth deviation is the predetermined value or more, the control device 22 controls the forward thrust such that the speed of the ship 1 decreases from the current speed. Thus, it is possible to decrease a turning radius when the course of the ship 1 is changed.

Note that the course change is not limited to the course change at the scheduled course change position and includes course change when the ship 1 sailing at a position deviated from the scheduled course is returned to the scheduled course. For example, the position of the ship 1 may deviate from the scheduled course due to a natural phenomenon such as wind or tide. In such a case, the control device 22 changes the course of the ship 1 to return the ship 1 to the scheduled course. According to the present embodiment, the turning radius can also be decreased even when the course of the ship 1 is changed in order to return the ship 1 to the scheduled course.

Subsequently, the control device 22 will be further described with reference to FIGS. 3(*a*) to 3(*c*). In the present embodiment, the control device 22 converts the azimuth deviation between the target bow azimuth and the actual bow azimuth into a turning ratio, and controls the degree of forward thrust and the degree of turning force based on the turning ratio. The turning ratio indicates a ratio between the degree of forward thrust and the degree of turning force.

Figure 3:
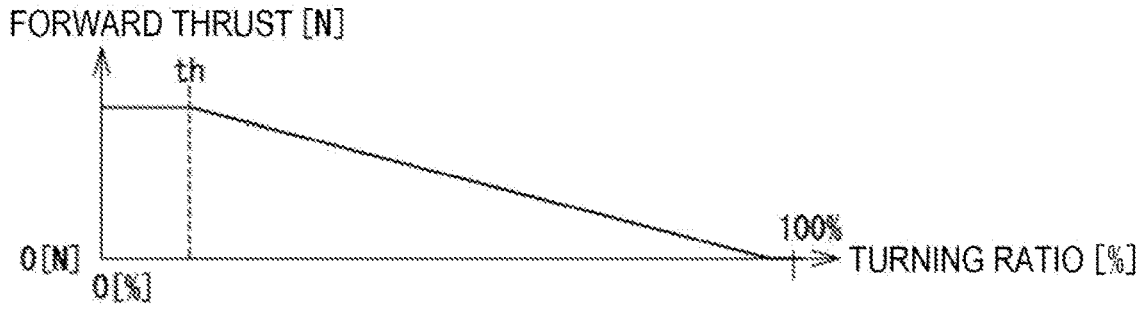
FIG. 3(*a*) is a graph illustrating a relationship between a turning ratio and the degree of forward thrust.
Figure 3:
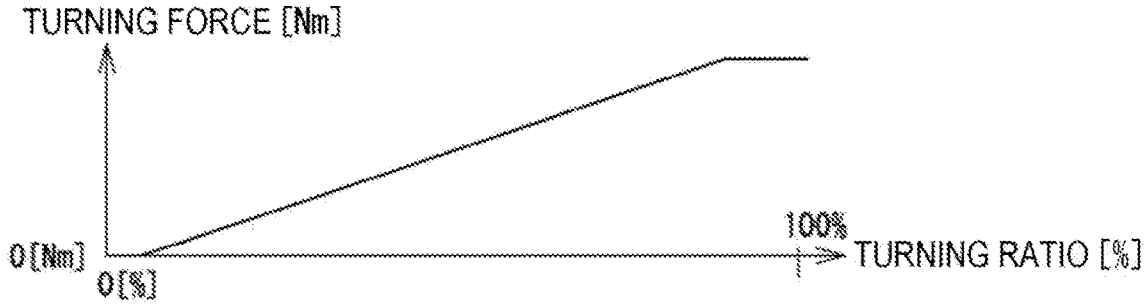
Figure 3:
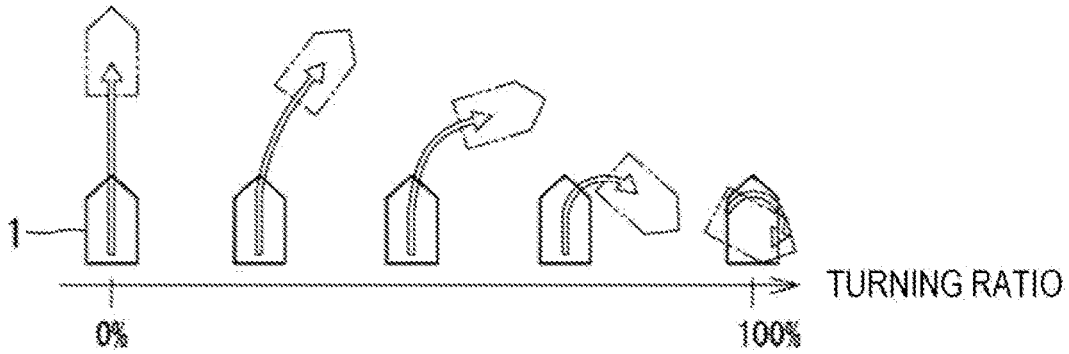

FIG. 3(*a*) is a graph illustrating a relationship between the turning ratio and the degree of forward thrust. FIG. 3(*b*) is a graph illustrating a relationship between the turning ratio and the degree of turning force. FIG. 3(*c*) is a view illustrating movement of the ship 1 according to the turning ratio. In FIGS. 3(*a*) to 3(*c*), the horizontal axis indicates the turning ratio. In FIG. 3(*a*), the vertical axis indicates the degree of forward thrust. In FIG. 3(*b*), the vertical axis indicates the degree of turning force.

As illustrated in FIG. 3(*a*), the control device 22 controls the forward thrust such that the forward thrust decreases as the turning ratio increases in a range in which the turning ratio is a threshold th or more. As illustrated in FIG. 3(*b*), the control device 22 controls the turning force such that the turning force increases as the turning ratio increases. As a result, as illustrated in FIG. 3(*c*), the turning radius decreases as the turning ratio increases. In addition, the turning radius increases as the turning ratio decreases. When the azimuth deviation between the target bow azimuth and the actual bow azimuth is zero, the turning ratio is 0%. As a result, since the turning force is zero, the ship 1 moves only with the forward thrust. Thus, the ship 1 moves to the bow azimuth.

In a case where the azimuth deviation between the target bow azimuth and the actual bow azimuth is the predetermined value or more, the control device 22 converts the azimuth deviation into the turning ratio such that the turning ratio increases as the azimuth deviation increases. Thus, in a case where the azimuth deviation is the predetermined value or more, the forward thrust decreases, the turning force increases, and the turning radius decreases as the azimuth deviation increases. As a result, overshoot of the ship 1 is less likely to occur when the course of the ship 1 is changed. In addition, according to the present embodiment, since the control device 22 controls the degree of forward thrust and the degree of turning force using the turning ratio, computing for controlling the degree of forward thrust and the degree of turning force is facilitated.

Note that in the present embodiment, the ship 1 can pivotally turn. Thus, the turning ratio can be set to 100% to pivotally turn the ship 1. That is, when the turning ratio is 100%, the degree of forward thrust is zero, and the speed of the ship 1 is zero. As a result, the ship 1 moves only with the turning force, and pivotally turns. According to the present embodiment, when the course of the ship 1 is changed, movement of the ship 1 can be controlled from a movement state in which the ship 1 moves forward to a movement state in which the ship 1 pivotally turns, so that the mobility of the ship 1 can be further enhanced.

Figure 4:
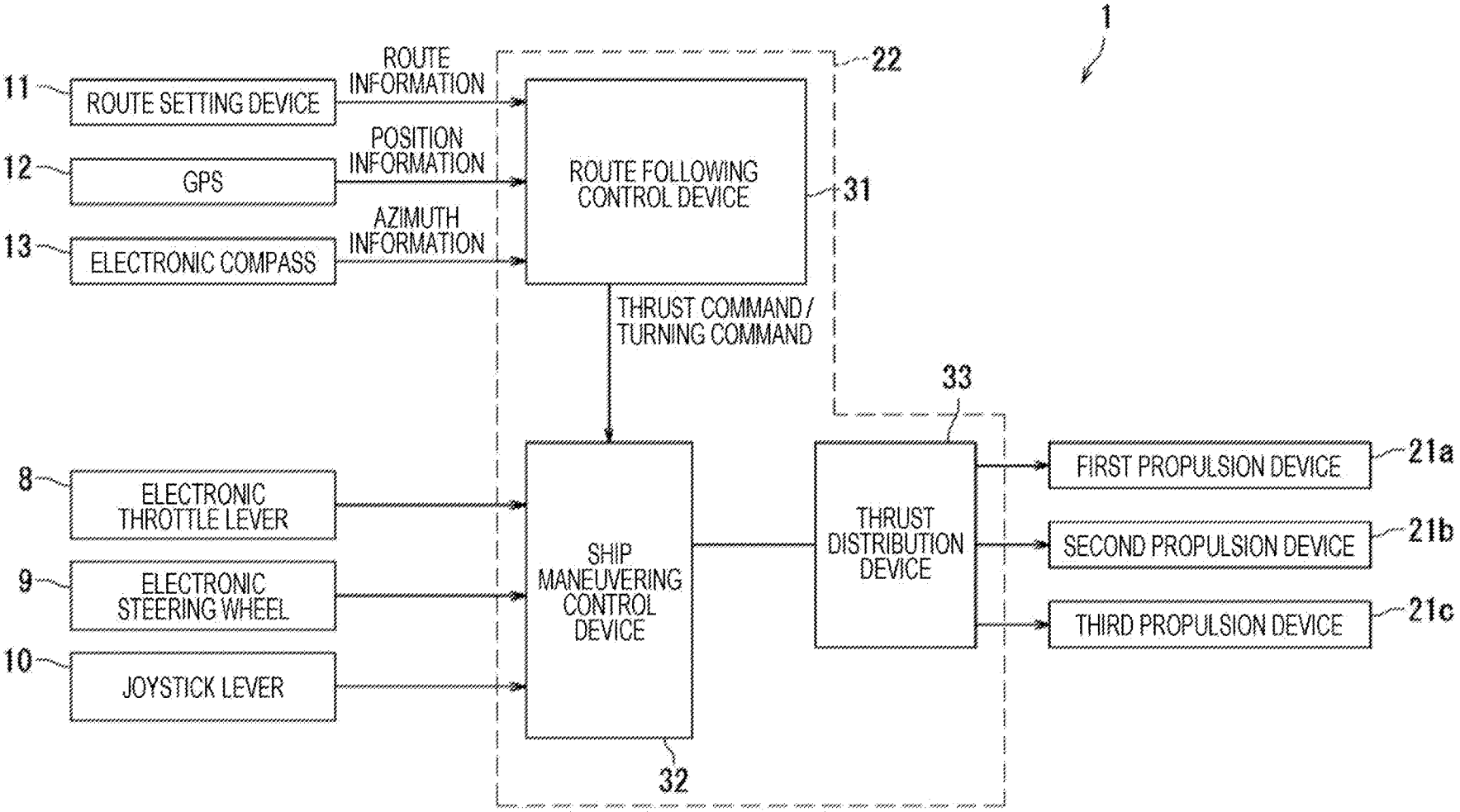
FIG. 4 is a block diagram illustrating the configuration of the ship according to the first embodiment of the present invention.

Subsequently, the configuration of the control device 22 will be further described with reference to FIGS. 4 to 7. FIG. 4 is a block diagram illustrating the configuration of the ship 1 of the present embodiment. As illustrated in FIG. 4, the control device 22 has a route following control device 31, a ship maneuvering control device 32, and a thrust distribution device 33. In the present embodiment, the route following control device 31 is one example of a ship maneuvering device.

When the right throttle lever of the electronic throttle lever 8 is operated by the ship operator while the manual mode is valid, the ship maneuvering control device 32 outputs, to the thrust distribution device 33, a signal commanding the rotation speed of the engine 2*a* and the switching state of the switching clutch 3*a* based on a signal output from the electronic throttle lever 8. The thrust distribution device 33 outputs, to the ECU 6*a* and the switching clutch 3*a*, a signal for controlling the engine 2*a* and the switching clutch 3*a* based on the signal output from the ship maneuvering control device 32.

When the left throttle lever of the electronic throttle lever 8 is operated by the ship operator while the manual mode is valid, the ship maneuvering control device 32 outputs, to the thrust distribution device 33, a signal commanding the rotation speed of the engine 2*b* and the switching state of the switching clutch 3*b* based on a signal output from the electronic throttle lever 8. The thrust distribution device 33 outputs, to the ECU 6*b* and the switching clutch 3*b*, a signal for controlling the engine 2*b* and the switching clutch 3*b* based on the signal output from the ship maneuvering control device 32.

When the manual mode is valid, the ship maneuvering control device 32 outputs, to the thrust distribution device 33, a signal commanding the rudder angles of the rudders 5*a*, 5*b* based on a signal output from the electronic steering wheel 9. The thrust distribution device 33 outputs, to actuators (e.g., hydraulic circuits) that drive the rudders 5*a*, 5*b*, a signal for controlling the actuators that drive the rudders 5*a*, 5*b* based on the signal output from the ship maneuvering control device 32.

When the manual mode is valid and a signal indicating the tilting direction (operation direction) and tilting amount (operation amount) of the lever is input from the joystick lever 10 to the ship maneuvering control device 32, the ship maneuvering control device 32 outputs, to the thrust distribution device 33, a signal commanding the thrust and turning force for moving the ship 1 in the tilting direction of the lever with the thrust according to the tilting amount of the lever. More specifically, the ship maneuvering control device 32 outputs a signal indicating the degree and direction of thrust in the front-back direction, a signal indicating the degree and direction of thrust in the left-right direction, and a signal indicating the degree of turning force and the turning direction (rotation direction). Based on the signal output from the ship maneuvering control device 32, the thrust distribution device 33 outputs a signal for controlling the rotation speeds of the engines 2*a*, 2*b*, the switching states of the switching clutches 3*a*, 3*b*, the rudder angles of the rudders 5*a*, 5*b*, and the rotation speed and rotation direction of the motor 7*b* to the ECUs 6*a*, 6*b*, the switching clutches 3*a*, 3*b*, the actuators that drive the rudders 5*a*, 5*b*, and the controller 7*c*.

When the manual mode is valid and a signal indicating the rotation direction (operation direction) and rotation amount (operation amount) of the lever is input from the joystick lever 10 to the ship maneuvering control device 32, the ship maneuvering control device 32 outputs, to the thrust distribution device 33, a signal commanding the turning force for pivotally turning the ship 1 in the rotation direction of the lever with the thrust according to the rotation amount of the lever. More specifically, the ship maneuvering control device 32 outputs a signal indicating the degree of turning force and the turning direction (rotation direction). Based on the signal output from the ship maneuvering control device 32, the thrust distribution device 33 outputs a signal for controlling the rotation speeds of the engines 2*a*, 2*b*, the switching states of the switching clutches 3*a*, 3*b*, the rudder angles of the rudders 5*a*, 5*b*, and the rotation speed and rotation direction of the motor 7*b* to the ECUs 6*a*, 6*b*, the switching clutches 3*a*, 3*b*, the actuators that drive the rudders 5*a*, 5*b*, and the controller 7*c*.

When the automatic mode is valid, the route following control device 31 outputs, to the ship maneuvering control device 32, a thrust command and a turning command for causing the ship 1 to follow the scheduled course based on the route information acquired from the route setting device 11, the position information acquired from the GPS device 12, and the azimuth information acquired from the electronic compass 13. In the present embodiment, the thrust command indicates the forward thrust. In addition, the turning command indicates the moment (turning force and turning direction) of force for turning the ship 1.

When the automatic mode is valid, the ship maneuvering control device 32 outputs, to the thrust distribution device 33, a signal indicating the degree and direction of thrust in the front-back direction, a signal indicating the degree and direction of thrust in the left-right direction, and a signal (signal indicating the moment of force for turning the ship 1) indicating the degree and turning direction (rotation direction) of turning force based on the thrust command and turning command output from the route following control device 31.

The thrust distribution device 33 controls the first to third propulsion devices 21*a* to 21*c* such that the resultant force of thrust generated from the first to third propulsion devices 21*a* to 21*c* coincides with the forward thrust commanded by the thrust command and the moment commanded by the turning command. Specifically, based on the signal output from the ship maneuvering control device 32, the thrust distribution device 33 outputs a signal for controlling the rotation speeds of the engines 2*a*, 2*b*, the switching states of the switching clutches 3*a*, 3*b*, the rudder angles of the rudders 5*a*, 5*b*, and the rotation speed and rotation direction of the motor 7*b* to the ECUs 6*a*, 6*b*, the switching clutches 3*a*, 3*b*, the actuators that drive the rudders 5*a*, 5*b*, and the controller 7*c*.

Figure 5:
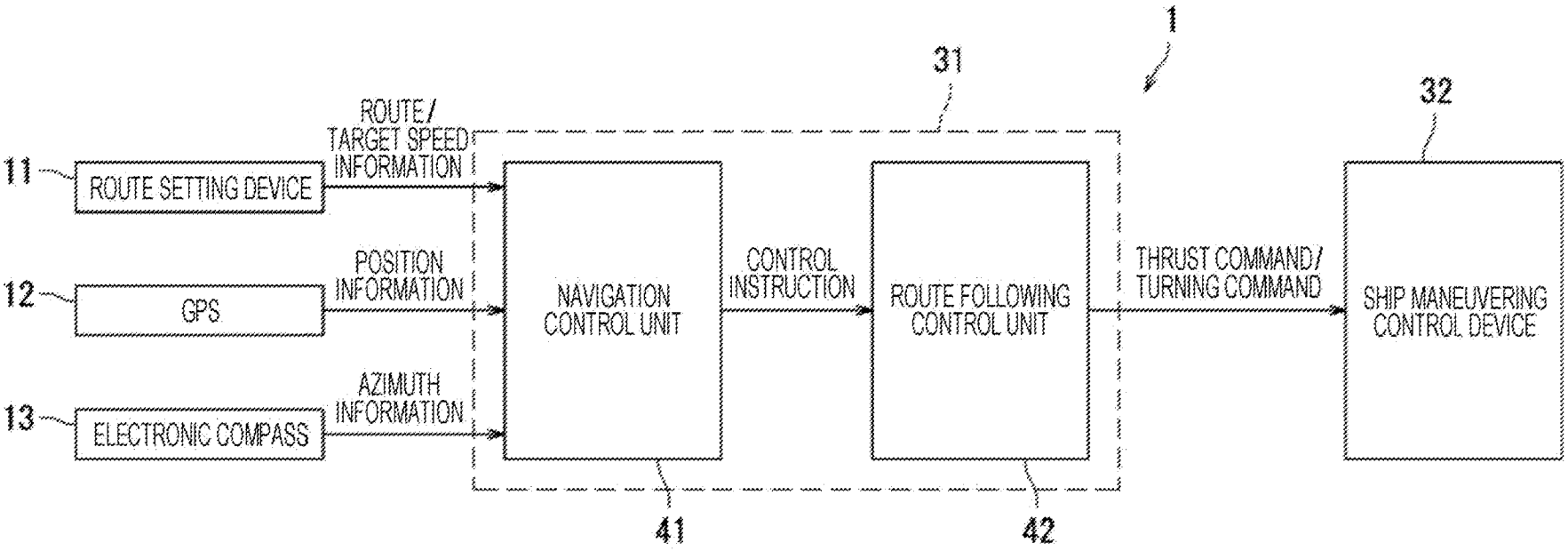
FIG. 5 is a block diagram illustrating part of the configuration of the ship according to the first embodiment of the present invention.

Subsequently, the route setting device 11 and the route following control device 31 will be further described with reference to FIG. 5. FIG. 5 is a block diagram illustrating part of the configuration of the ship 1 of the present embodiment. First, the route setting device 11 will be described.

As illustrated in FIG. 5, in the present embodiment, the route setting device 11 outputs the route information and target speed information to the route following control device 31. The target speed information indicates the target speed of the ship 1.

Specifically, in the present embodiment, the route setting device 11 receives the input of a target speed instruction. Thus, the ship operator can instruct the target speed by performing touch operation on the touch display 11*a* of the route setting device 11. Note that the target speed may be a constant value or an arbitrary value may be set for each transit point as the target speed.

Subsequently, the route following control device 31 will be described. As illustrated in FIG. 5, the route following control device 31 includes a navigation control unit 41 and a route following control unit 42. In the present embodiment, the route following control unit 42 is one example of a control unit.

The navigation control unit 41 outputs, to the route following control unit 42, a control instruction for moving the ship 1 toward the transit point based on the position information and the route information. Specifically, as already described above, the route information indicates arrangement of the plurality of transit points. The navigation control unit 41 acquires the current position of the ship 1 from the position information, adds the current position of the ship 1 to arrangement of the plurality of transit points, and sets a transit point ahead of the current position of the ship 1 as a target transit point. As a result, a target route line which is a straight route line from the current position of the ship 1 to the target transit point is set.

The navigation control unit 41 outputs, as a control instruction, information indicating the position of the target transit point to the route following control unit 42. Moreover, the navigation control unit 41 outputs, as a control instruction, the position information, the azimuth information, and the target speed information to the route following control unit 42.

Note that the navigation control unit 41 determines, based on the position information, whether or not the ship 1 has reached the target transit point. For example, the navigation control unit 41 may determine that the ship 1 has reached the target transit point when a distance between the current position of the ship 1 and the target transit point reaches a distance within a certain range. In response to determining that the ship 1 has reached the target transit point, the navigation control unit 41 updates, as the target transit point, the next transit point on the scheduled course of the ship 1.

The route following control unit 42 outputs, to the ship maneuvering control device 32, the thrust command and turning command for causing the ship 1 to follow the scheduled course based on the information input from the navigation control unit 41.

Figure 6:
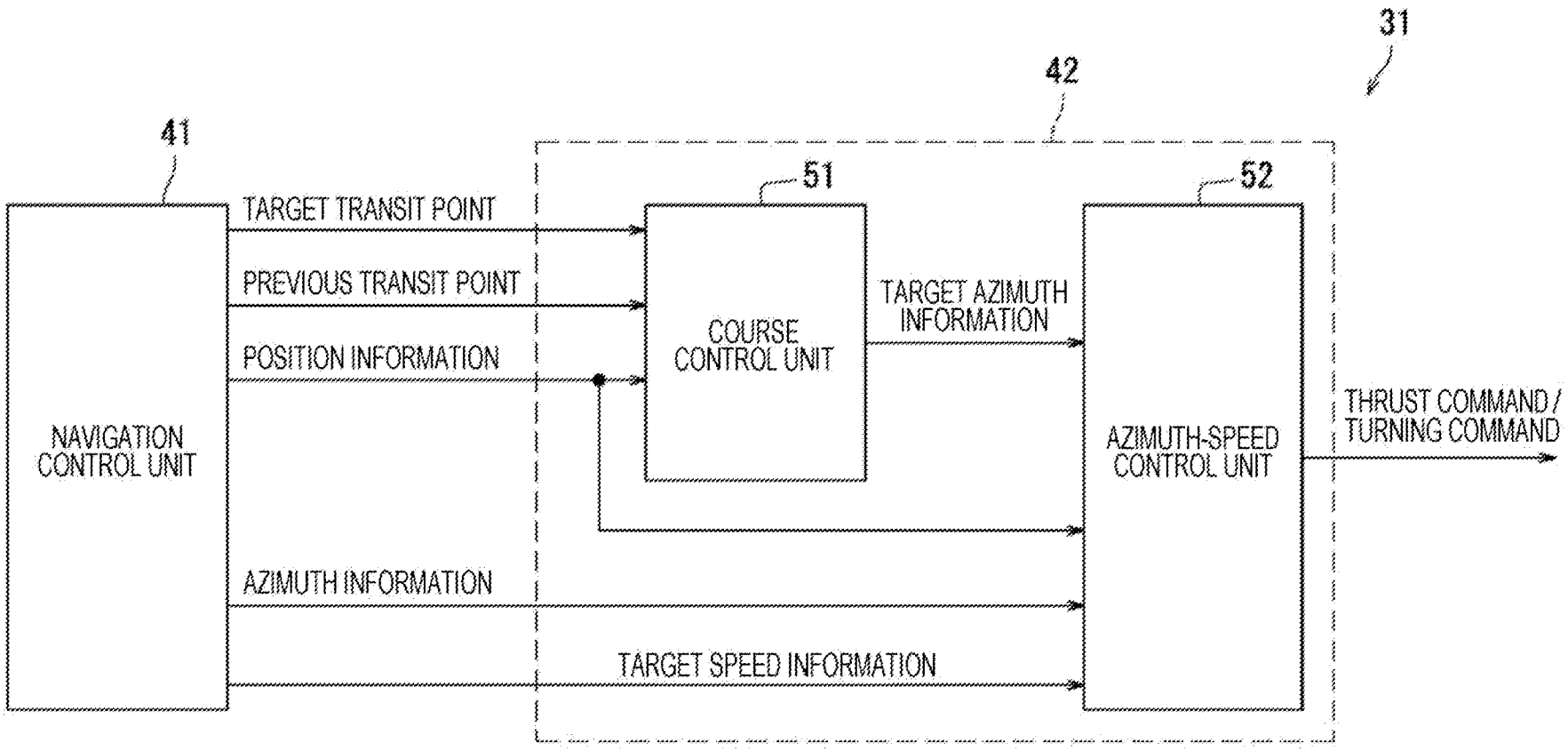
FIG. 6 is a block diagram illustrating the configuration of a route following control device according to the first embodiment of the present invention.

Subsequently, the route following control unit 42 will be described with reference to FIG. 6. FIG. 6 is a block diagram illustrating the configuration of the route following control device 31 of the present embodiment. As illustrated in FIG. 6, the route following control unit 42 includes a course control unit 51 and an azimuth-speed control unit 52.

The course control unit 51 acquires the current position of the ship 1 from the position information, and sets the target bow azimuth of the ship 1 based on the position of the target transit point and the current position of the ship 1. The target bow azimuth indicates a direction from the current position of the ship 1 toward the target transit point. The course control unit 51 outputs target azimuth information indicating the target bow azimuth to the azimuth-speed control unit 52.

In the present embodiment, the navigation control unit 41 further outputs, to the course control unit 51, information indicating the position of a previous transit point before the target transit point based on the route information. The course control unit 51 acquires a scheduled route line which is a straight route line from the previous transit point before the target transit point toward the target transit point. Then, the target bow azimuth is corrected according to a course deviation indicating a distance between the scheduled route line and the current position of the ship 1.

Note that the course control unit 51 may acquire an intersection position at which a circle about the center of gravity of the ship 1 intersects the scheduled route line, and as the target bow azimuth, set a direction from the current position of the ship 1 toward the intersection position. Here, the radius of the circle about the center of gravity of the ship 1 is defined in advance.

The azimuth-speed control unit 52 generates the thrust command and turning command for causing the ship 1 to follow the scheduled course based on the target speed information, the azimuth information, the position information, and the target azimuth information. Specifically, the azimuth-speed control unit 52 acquires the actual bow azimuth from the azimuth information, acquires the target bow azimuth from the target azimuth information, and acquires the azimuth deviation between the actual bow azimuth and the target bow azimuth. Then, the thrust command and the turning command are generated based on the azimuth deviation.

More specifically, the azimuth-speed control unit 52 acquires an actual speed, which is the current speed of the ship 1, from the position information. Then, in a case where the azimuth deviation is the predetermined value or more, the target speed is corrected based on the azimuth deviation such that the speed of the ship 1 is decreased from the actual speed, and the thrust command is generated based on the corrected target speed. The target speed is one example of a target value of a parameter related to the thrust of the ship 1.

Figure 7:
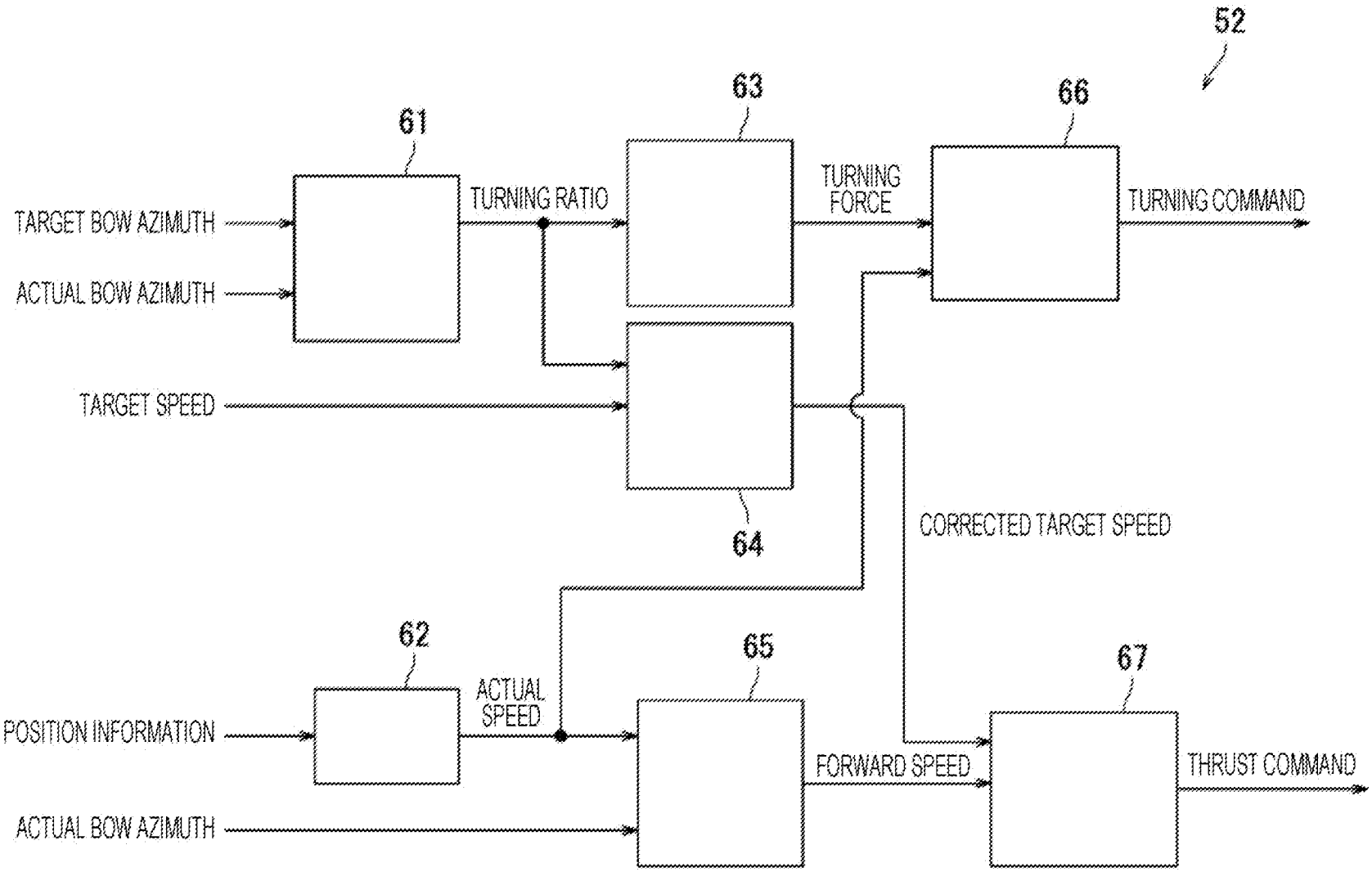
FIG. 7 is a block diagram illustrating the configuration of an azimuth-speed control unit.

Subsequently, the configuration of the azimuth-speed control unit 52 will be further described with reference to FIG. 7. FIG. 7 is a block diagram illustrating the configuration of the azimuth-speed control unit 52. As illustrated in FIG. 7, the azimuth-speed control unit 52 includes an azimuth deviation acquisition unit 61, an actual speed computing unit 62, a turning force conversion unit 63, a target speed correction unit 64, a coordinate conversion unit 65, a turning force limiting unit 66, and a forward speed control unit 67.

The azimuth deviation acquisition unit 61 acquires the azimuth deviation between the target bow azimuth and the actual bow azimuth, and sets the turning ratio based on the azimuth deviation. For example, the azimuth deviation acquisition unit 61 sets the turning ratio by executing PD control compensation on the azimuth deviation.

As described with reference to FIGS. 3(*a*) to 3(*c*), the turning force conversion unit 63 sets the turning force from the turning ratio. Specifically, the control device 22 stores a turning ratio conversion table (lookup table). The turning ratio conversion table defines a relationship between the turning ratio and the turning force such that the turning force increases as the turning ratio increases. The turning force conversion unit 63 refers to the turning ratio conversion table to acquire the turning force from the turning ratio.

The target speed correction unit 64 corrects the target speed based on the turning ratio. Specifically, the target speed correction unit 64 decreases the target speed in a case where the turning ratio is the threshold th or more. Specifically, the control device 22 stores a target speed conversion table (lookup table). The target speed conversion table defines a relationship between the amplification factor (gain) of the target speed and the turning ratio such that the amplification factor (gain) of the target speed decreases as the turning ratio increases in the range in which the turning ratio is the threshold th or more. Here, the amplification factor of the target speed is 0 or more and 1 or less. The amplification factor of the target speed is one example of the decrease rate of the target speed. The target speed correction unit 64 refers to the target speed conversion table to acquire the amplification factor of the target speed from the turning ratio. Then, the target speed is decreased based on the amplification factor of the target speed. Specifically, the target speed correction unit 64 performs multiplication of the target speed and the amplification factor to decrease the target speed.

The actual speed computing unit 62 acquires the actual speed of the ship 1 from the position information. Specifically, the actual speed computing unit 62 sequentially acquires, from the position information, the current position of the ship 1 that changes with time. Then, the actual speed vector of the ship 1 is acquired by differentiation.

The coordinate conversion unit 65 acquires a forward speed, which is the speed component of the actual bow azimuth, from the actual speed vector.

The forward speed control unit 67 outputs the thrust command based on the forward speed and the corrected target speed. In the present embodiment, the thrust command indicates the forward thrust (thrust for propelling the ship 1 to the actual bow azimuth). Specifically, the forward speed control unit 67 acquires a speed deviation between the corrected target speed and the forward speed, and executes PD control compensation on the speed deviation to set the forward thrust.

The turning force limiting unit 66 limits the turning force based on the actual speed. Specifically, the turning force limiting unit 66 sets the upper limit of the turning force according to the actual speed. In a case where the turning force set by the turning force conversion unit 63 does not exceed the upper limit, the turning force limiting unit 66 outputs the turning command indicating the turning force set by the turning force conversion unit 63. On the other hand, in a case where the turning force set by the turning force conversion unit 63 is the upper limit or more, the turning command indicating the upper limit is output.

According to the present embodiment, since the turning force can be restricted based on the actual speed, it is possible to avoid outward rolling of the ship 1 due to the turning force at the time of changing the course.

The configuration of the control device 22 has been described above with reference to FIGS. 4 to 7. Note that each unit forming the route following control device 31, the ship maneuvering control device 32, and the thrust distribution device 33 described with reference to FIG. 4 and the route following control device 31 described with reference to FIGS. 5 to 7 may be separate processing circuits or be collectively formed of one processing circuit. The processing circuit that executes each of the functions of the route following control device 31, the ship maneuvering control device 32, and the thrust distribution device 33 and the functions of the units forming the route following control device 31 may have a processor such as a CPU or have dedicated hardware.

In a case where the processing circuit has the processor, the processing circuit further has a memory. The memory stores various computer programs to be executed by the processor and various types of data. The memory is, for example, a semiconductor memory. The semiconductor memory includes, for example, a RAM and a ROM. Alternatively, the semiconductor memory may include, instead of the RAM and the ROM or in addition to the RAM and the ROM, at least one of a flash memory, an erasable programmable read only memory (EPROM), or an electrically erasable programmable read-only memory (EEPROM).

In a case where the processing circuit has the dedicated hardware, the processing circuit may be, for example, a single circuit, a composite circuit, a programmed processor, a parallel-programmed processor, an application specific integrated circuit (ASIC), a field-programmable gate array (FPGA), or a circuit combination thereof.

Figure 8:
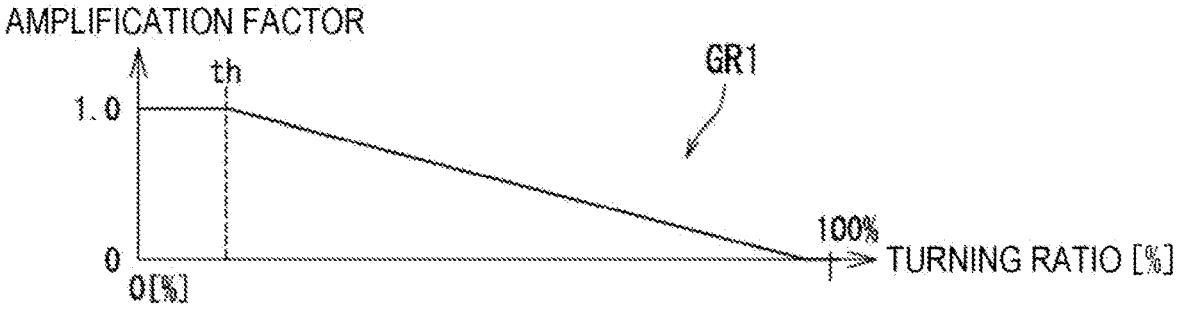
FIG. 8(*a*) is a graph defining a relationship between the turning ratio and the amplification factor of a target speed.
Figure 8:
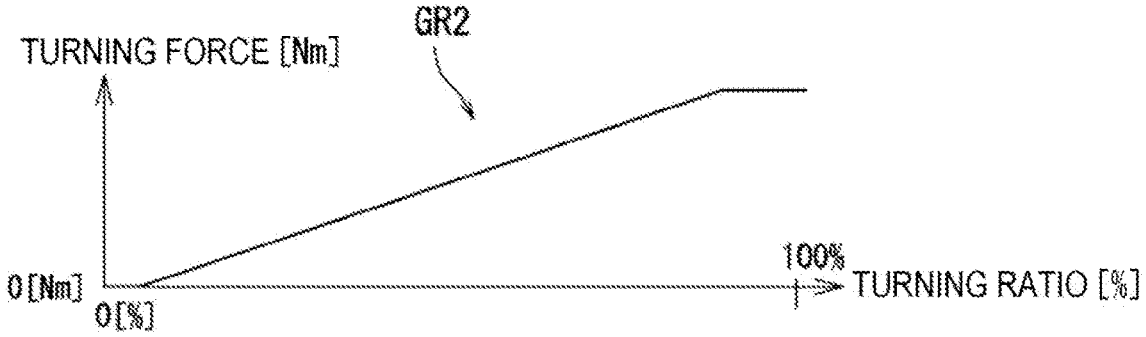
Figure 8:
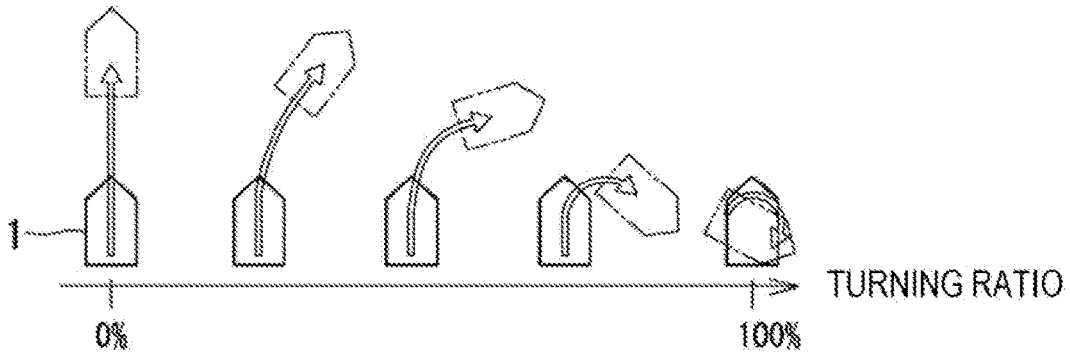

Subsequently, the target speed conversion table and the turning ratio conversion table will be described with reference to FIGS. 8(*a*) to 8(*c*). FIG. 8(*a*) is a graph GR1 defining the relationship between the turning ratio and the amplification factor (gain) of the target speed. FIG. 8(*b*) is a graph GR2 defining the relationship between the turning ratio and the degree of turning force. FIG. 8(*c*) is a view illustrating movement of the ship 1 according to the turning ratio. In FIGS. 8(*a*) to 8(*c*), the horizontal axis indicates the turning ratio. In FIG. 8(*a*), the vertical axis indicates the amplification factor (gain) of the target speed. In FIG. 8(*b*), the vertical axis indicates the degree of turning force.

As illustrated in FIG. 8(*a*), the range of the amplification factor (gain) is defined as 0 or more and 1 or less. The graph GR1 is defined such that the amplification factor (gain) is "1" in a range in which the turning ratio is less than the threshold th. Moreover, the graph GR1 is defined such that the amplification factor decreases as the turning ratio increases in the range in which the turning ratio is the threshold th or more. Specifically, the graph GR1 is defined such that the amplification factor (gain) is "0" in a range in which the turning ratio is around 100%. In other words, the graph GR1 is defined such that the decrease rate of the target speed is 0% in the range in which the turning ratio is less than the threshold th, the decrease rate of the target speed increases as the turning ratio increases in the range in which the turning ratio is the threshold th or more, and the decrease rate of the target speed is 100% in the range in which the turning ratio is around 100%.

The control device 22 stores the target speed conversion table corresponding to the graph GR1. The target speed correction unit 64 refers to the target speed conversion table to acquire the amplification factor corresponding to the turning ratio and correct the target speed by performing multiplication of the target speed and the amplification factor.

As illustrated in FIG. 8(*b*), the graph GR2 is defined such that the turning force increases as the turning ratio increases. The control device 22 stores the turning ratio conversion table corresponding to the graph GR2, and the turning force conversion unit 63 refers to the turning ratio conversion table to acquire the turning force from the turning ratio.

The target speed correction unit 64 corrects the target speed based on the target speed conversion table and the turning force conversion unit 63 sets the turning force based on the turning ratio conversion table, so that the turning radius decreases as the turning ratio increases as illustrated in FIG. 8(*c*). In addition, the turning radius increases as the turning ratio decreases.

Figure 9:
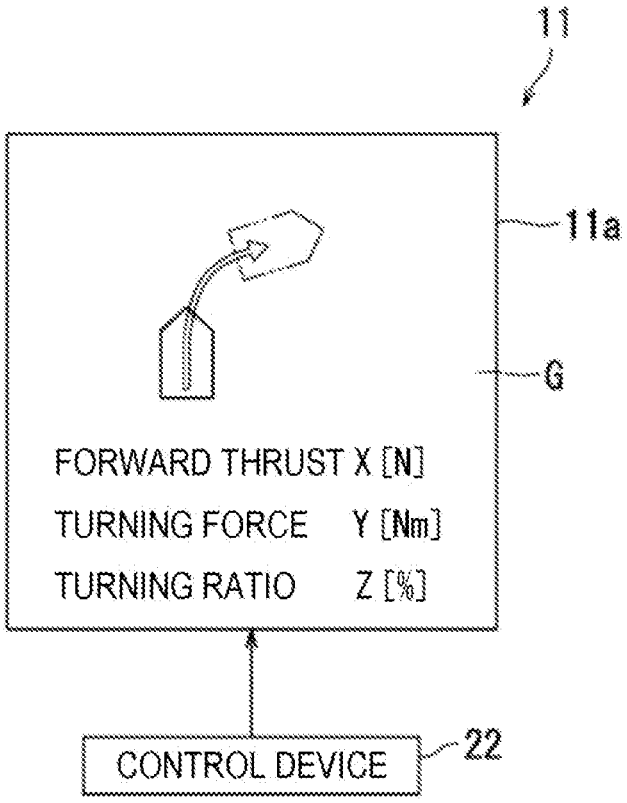
FIG. 9 is a view illustrating one example of a notification screen.

Subsequently, the control device 22 will be further described with reference to FIG. 9. In the present embodiment, when the automatic mode is valid, the control device 22 displays a notification screen G on the touch display 11*a* of the route setting device 11 when changing the course of the ship 1. FIG. 9 is a view illustrating one example of the notification screen G. In the present embodiment, the touch display 11*a* is one example of an indicator.

As illustrated in FIG. 9, when the automatic mode is valid, the control device 22 generates the notification screen G and display the notification screen G on the touch display 11*a* when changing the course of the ship 1. The notification screen G shows the turning ratio. For example, the notification screen G may display an object (e.g., icon or mark) visualizing the turning ratio, the value of the forward thrust, the value of the turning force, and the value of the turning ratio.

The control device 22 generates the notification screen G based on the turning ratio output from the azimuth deviation acquisition unit 61 (see FIG. 7), the turning command output from the turning force limiting unit 66 (see FIG. 7), and the thrust command output from the forward speed control unit 67 (see FIG. 7). For example, the control device 22 may select one object from the group of objects visualizing the turning ratio, based on the turning ratio output from the azimuth deviation acquisition unit 61 (see FIG. 7).

According to the present embodiment, when the automatic mode is valid, the control device 22 displays the notification screen G on the touch display 11*a* when changing the course of the ship 1, so that the ship operator can be notified of the movement state of the ship 1 when the course of the ship 1 is changed. In particular, in the present embodiment, in a case where the azimuth deviation is the predetermined value or more at the time of changing the course of the ship 1, the speed of the ship 1 decreases. Thus, the ship operator can recognize, via the notification screen G, that the speed of the ship 1 slows down by the automatic mode.

Note that the control device 22 may select one object from the group of objects visualizing the turning ratio, based on the turning command output from the turning force limiting unit 66 (see FIG. 7) and the turning ratio conversion table. Thus, in a case where the turning force is restricted to the upper limit by the turning force limiting unit 66, the actual turning ratio can be notified.

Figure 10:
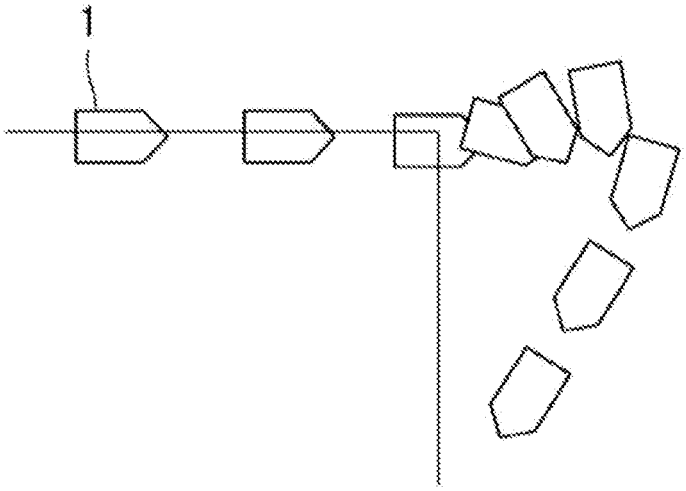
FIG. 10 is a view illustrating one example of movement of the ship according to the first embodiment of the present invention.

Subsequently, one example of movement at the time of changing the course of the ship 1 will be described with reference to FIG. 10. FIG. 10 is a view illustrating one example of movement of the ship 1 of the present embodiment. Specifically, FIG. 10 illustrates movement of the ship 1 when the automatic mode is valid.

As illustrated in FIG. 10, when the automatic mode is valid, the ship 1 changes the bow azimuth by turning round at the time of changing the course. Specifically, the thrust distribution device 33 controls the first to third propulsion devices 21*a* to 21*c* based on the thrust command and turning command output from the route following control device 31, thereby changing the bow azimuth while the ship 1 is turning round. As a result, the turning radius at the time of changing the course decreases.

The first embodiment of the present invention has been described above with reference to FIGS. 1 to 10. According to the present embodiment, the turning radius can be decreased when the course of the ship 1 is changed. In addition, according to the present embodiment, since the decrease rate of the forward speed increases as the azimuth deviation increases, a braking effect can be obtained when the ship 1 steeply turns.

Note that in the present embodiment, the azimuth-speed control unit 52 calculates the actual speed based on the position information acquired from the GPS device 12, but may acquire the actual speed based on the output of an inertial measurement unit (IMU).

In the present embodiment, the ship 1 includes the electronic compass 13, but may include a gyro compass instead of the electronic compass 13.

In the present embodiment, the control device 22 stores the lookup table (turning ratio conversion table) for converting the turning ratio into the turning force, but may store a mathematical equation corresponding to the graph GR2 described with reference to FIG. 8(*b*).

In the present embodiment, the control device 22 stores the lookup table (target speed conversion table) defining the relationship between the turning ratio and the amplification factor (gain) of the target speed, but may store a mathematical equation corresponding to the graph GR1 described with reference to FIG. 8(*a*).

In the present embodiment, the ship 1 is the twin-screw propulsion type shaft ship including one side thruster, but may be a single-screw propulsion type ship. The single-screw propulsion type ship may be a shaft ship, a ship including one outboard engine, or a ship including one inboard-outdrive engine (stern drive device).

Figure 11:
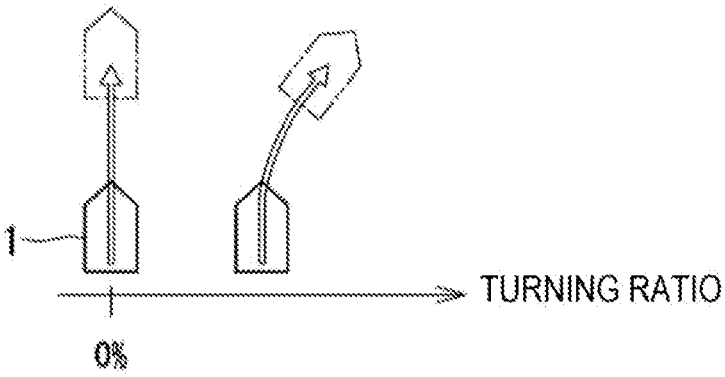
FIG. 11 is a view illustrating another example of movement of the ship according to the turning ratio.

Since the single-screw propulsion type ship cannot make pivot turn or oblique sailing, the range of the movement state of the ship 1 is limited as compared with the range of the movement state illustrated in FIG. 3(*c*), as illustrated in FIG. 11. Note that even in the case of the single-screw propulsion type ship, it is possible, according to the present embodiment, to turn the ship 1 with the forward speed decreased at the time of changing the course of the ship 1, and therefore, it is possible to decrease the turning radius. Note that in a case where the ship 1 is the single-screw propulsion type ship, the thrust distribution device 33 may be omitted.

Second Embodiment

Hereinafter, a second embodiment of the present invention will be described with reference to FIGS. 12 to 14. Note that contents different from those in the first embodiment will be described, and description of the same contents as those in the first embodiment will be omitted. The second embodiment is different from the first embodiment in that the thrust in the lateral direction (left-right direction) is controlled in addition to the forward thrust and the turning force when the automatic mode is valid. In addition, in the second embodiment, the ship 1 is a ship other than a single-screw propulsion type ship. In other words, the ship 1 is a ship capable of making oblique sailing and pivot turn. Hereinafter, the thrust in the lateral direction may be referred to as "lateral thrust."

Figure 12:
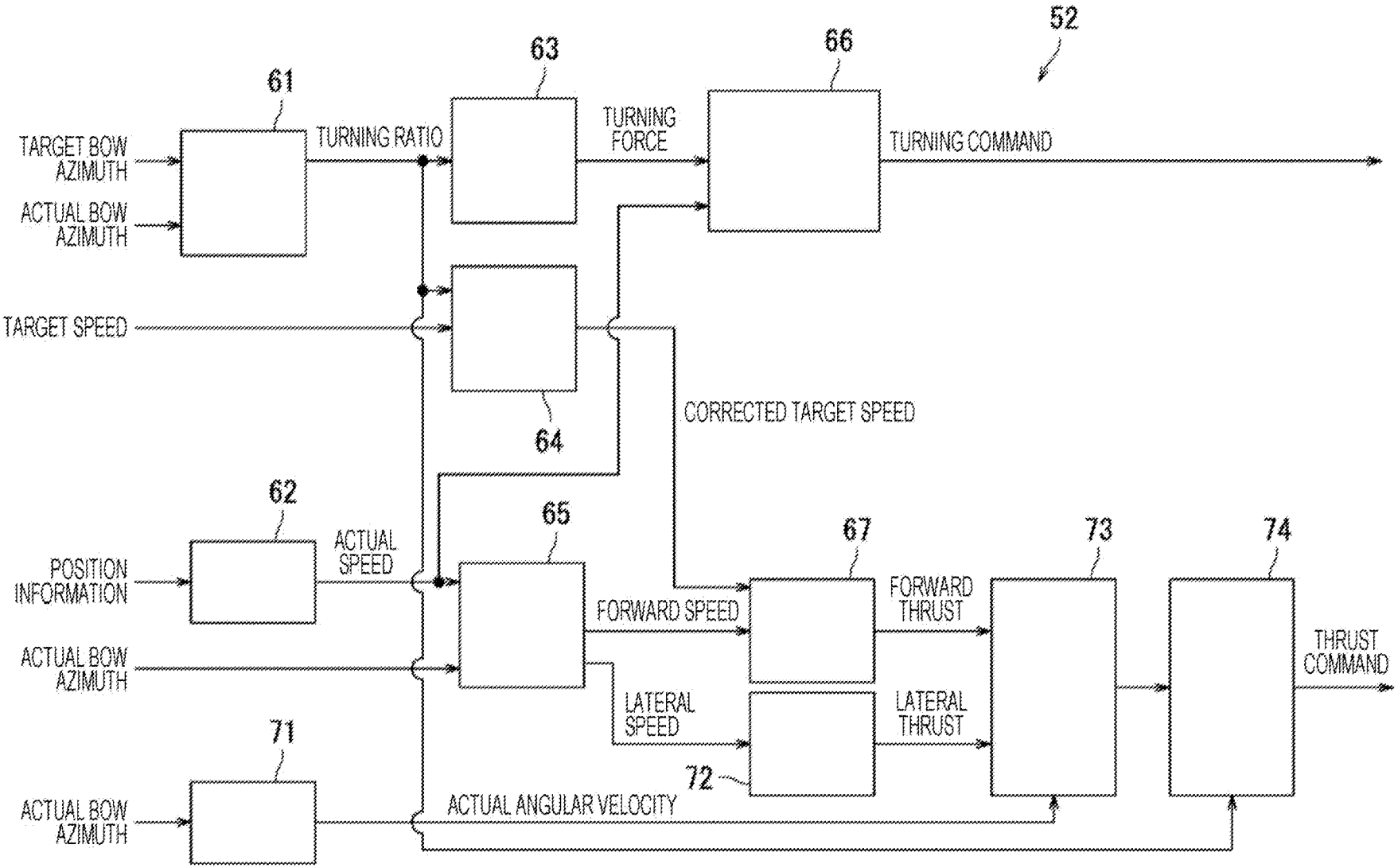
FIG. 12 is a block diagram illustrating the configuration of an azimuth-speed control unit of a route following control device according to a second embodiment of the present invention.

FIG. 12 is a block diagram illustrating the configuration of the azimuth-speed control unit 52 of the route following control device 31 of the present embodiment. As illustrated in FIG. 12, the azimuth-speed control unit 52 further includes an actual angular velocity computing unit 71, a lateral speed control unit 72, an azimuth correction unit 73, and a lateral thrust limiting unit 74.

The actual angular velocity computing unit 71 acquires the current angular velocity of the ship 1 from the azimuth information (information indicating the actual bow azimuth of the ship 1). Specifically, the actual angular velocity computing unit 71 sequentially acquires the actual bow azimuth of the ship 1 that changes with time. Then, the current angular velocity of the ship 1 is acquired by differentiation. Hereinafter, the current angular velocity of the ship 1 may be referred to as an "actual angular velocity."

The coordinate conversion unit 65 acquires the forward speed and a lateral speed from the actual speed vector. The lateral speed is a speed component of the actual speed vector in a direction orthogonal to the actual bow azimuth.

The lateral speed control unit 72 sets, based on the lateral speed, the lateral thrust for setting the lateral speed to zero. Specifically, the lateral speed control unit 72 sets the lateral thrust by executing PD control compensation on a speed deviation between the lateral speed output from the coordinate conversion unit 65 and the target speed of the lateral speed. Here, the target speed of the lateral speed indicates zero.

The azimuth correction unit 73 corrects, based on the actual angular velocity, the azimuth (azimuth to which the forward thrust is generated) of the forward thrust set by the forward speed control unit 67 and the azimuth (azimuth to which the lateral thrust is generated) of the lateral thrust set by the lateral speed control unit 72.

The lateral thrust limiting unit 74 corrects the degree of lateral thrust based on the turning ratio. Moreover, the lateral thrust limiting unit 74 sets the degree of lateral thrust to zero based on the turning ratio. Specifically, the lateral thrust limiting unit 74 sets the degree of lateral thrust to zero when the turning ratio reaches a set value or less.

Specifically, the control device 22 stores a lateral thrust conversion table (lookup table). The lateral thrust conversion table defines a relationship between the turning ratio and the amplification factor (gain) of the lateral thrust such that the amplification factor (gain) of the lateral thrust increases as the turning ratio increases in a range in which the turning ratio exceeds the set value. Here, the amplification factor of the lateral thrust is 0 or more and 1 or less. Further, in the lateral thrust conversion table, the amplification factor (gain) of the lateral thrust is defined as "0" in the range in which the turning ratio is the set value or less. The lateral thrust limiting unit 74 refers to the lateral thrust conversion table to acquire the amplification factor of the lateral thrust from the turning ratio. Then, the lateral thrust is corrected based on the amplification factor of the lateral thrust. Specifically, the lateral thrust limiting unit 74 performs multiplication of the lateral thrust and the amplification factor to correct the lateral thrust.

Note that in the present embodiment, the route setting device 11 receives the input of an instruction to set the validity/invalidity of the function of the lateral thrust limiting unit 74. Thus, the ship operator can set the validity/invalidity of the function of the lateral thrust limiting unit 74 by performing touch operation on the touch display 11*a* of the route setting device 11. In a case where the function of the lateral thrust limiting unit 74 is validated, the lateral thrust limiting unit 74 performs multiplication of the lateral thrust and the amplification factor to correct the lateral thrust. In a case where the function of the lateral thrust limiting unit 74 is invalidated, the lateral thrust limiting unit 74 commands the lateral thrust, the degree of which is set by the lateral speed control unit 72 and the azimuth of which is corrected by the azimuth correction unit 73.

Subsequently, the lateral thrust conversion table will be described with reference to FIG. 13. FIG. 13 is a graph GR4 defining the relationship between the turning ratio and the amplification factor (gain) of the lateral thrust. In FIG. 13, the horizontal axis indicates the turning ratio. The vertical axis indicates the amplification factor (gain) of the lateral thrust.

Figure 13:
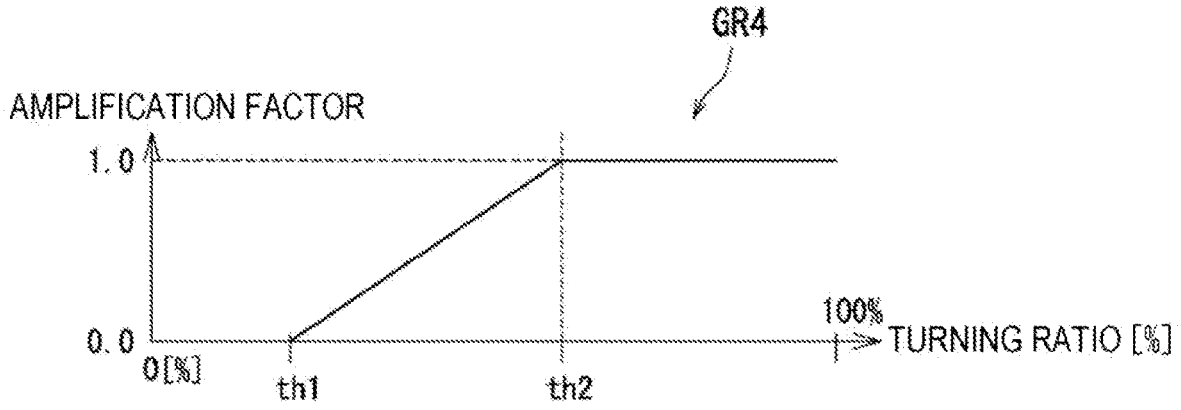
FIG. 13 is a graph defining a relationship between the turning ratio and the amplification factor of lateral thrust.

As illustrated in FIG. 13, the range of the amplification factor (gain) is defined as 0 or more and 1 or less. The graph GR4 defines the amplification factor (gain) of the lateral thrust as "0" in a range in which the turning ratio is a first threshold th1 or less. In a range in which the turning ratio is greater than the first threshold th1 and a second threshold th2 or less, the amplification factor (gain) of the lateral thrust is defined to increase as the turning ratio increases. Further, the amplification factor (gain) of the lateral thrust is defined as "1" in a range in which the turning ratio is greater than the second threshold th2.

The control device 22 stores the lateral thrust conversion table corresponding to the graph GR4. The lateral thrust limiting unit 74 refers to the lateral thrust conversion table to acquire the amplification factor corresponding to the turning ratio and correct the lateral thrust by performing multiplication of the lateral thrust and the amplification factor. As a result, in the range in which the turning ratio is the first threshold th1 or less, the lateral thrust is zero. In other words, in the range in which the turning ratio is the first threshold th1 or less, the lateral thrust is invalidated. In the range in which the turning ratio is greater than the first threshold th1 and the second threshold th2 or less, the lateral thrust increases as the turning ratio increases.

Subsequently, one example of movement at the time of changing the course of the ship 1 will be described with reference to FIG. 14. FIG. 14 is a view illustrating one example of movement of the ship 1 of the present embodiment. Specifically, FIG. 14 illustrates movement of the ship 1 when the automatic mode is valid.

Figure 14:
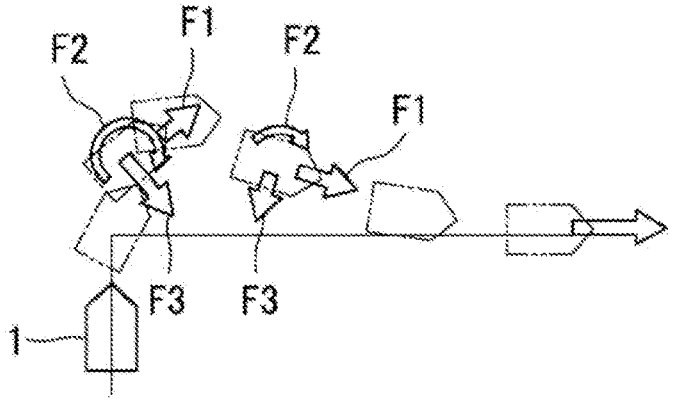
FIG. 14 is a view illustrating one example of movement of a ship according to the second embodiment of the present invention.

As illustrated in FIG. 14, when the automatic mode is valid, the ship 1 generates the lateral thrust F3 in addition to the forward thrust F1 and the turning force F2 when changing the course thereof. As a result, sideslip of the ship 1 is reduced by the lateral thrust F3, and the turning radius can be further decreased.

Specifically, in a case where the ship 1 turns round by the turning force while the forward speed is decreased at the time of changing the course, there is a probability that a lateral speed component is generated when the ship 1 turns round by the turning force and sideslip of the ship 1 occurs. For this reason, there is a probability that the ship 1 moves away from the scheduled course (scheduled route line) due to the lateral speed component. On the other hand, according to the present embodiment, since the lateral thrust F3 for setting the lateral speed to zero is generated, sideslip of the ship 1 can be reduced.

The second embodiment of the present invention has been described above with reference to FIGS. 12 to 14. According to the present embodiment, the turning radius can be decreased while sideslip of the ship 1 is reduced.

In addition, according to the present embodiment, the azimuth of the forward thrust and the azimuth of the lateral thrust are corrected using the actual angular velocity so that deviation of the movement trajectory of the ship 1 due to a signal transmission delay component can be reduced.

Specifically, the route following control device 31 outputs the thrust command and the turning command, and the thrust distribution device 33 (see FIG. 4) controls the first to third propulsion devices 21*a* to 21*c* based on the thrust command and the turning command, whereby the signal transmission delay component is generated until movement of the ship 1 is detected by the GPS device 12 and the electronic compass 13 after the ship 1 has moved. As a result, since the actual bow azimuth of the ship 1 changes until the thrust command and the turning command are reflected in movement of the ship 1 after the route following control device 31 has output the thrust command and the turning command, the movement trajectory of the ship 1 may slightly bulge. On the other hand, in the present embodiment, it is possible to reflect, based on the actual angular velocity, deviation of the movement trajectory of the ship 1 due to the signal transmission delay component on the azimuth of the forward thrust and the azimuth of the lateral thrust. Thus, it is possible to reduce deviation of the movement trajectory of the ship 1 due to the signal transmission delay component.

According to the present embodiment, it is possible to increase the efficiency of energy for compensating for a route deviation between the scheduled route line (straight route line from the previous transit point before the target transit point toward the target transit point) and the target route line (straight route line from the current position of the ship 1 to the target transit point).

Specifically, in a case where the route deviation is small, the lateral thrust acts as force for compensating for the route deviation. For example, in a case where the ship 1 is following the straight scheduled route line, the lateral thrust acts as the force for compensating for the route deviation. However, in the case of compensating for the route deviation, the energy efficiency is higher when the turning force is used than when the lateral thrust is used. In the present embodiment, the turning ratio is low when the route deviation is small. In a case where the turning ratio is low, the lateral thrust limiting unit 74 decreases the lateral thrust. Thus, the route deviation is compensated by the turning force by an amount corresponding to the decrease of the lateral thrust. In a case where the turning ratio is the set value (first threshold th1) or less, the lateral thrust is zero, and therefore, the route deviation is compensated by the turning force. Thus, according to the present embodiment, the efficiency of energy for compensating for the route deviation can be increased.

Note that in the present embodiment, the azimuth-speed control unit 52 calculates the actual angular velocity based on the azimuth information, but may acquire the actual angular velocity based on the output of a gyro sensor or a gyro compass.

In the present embodiment, the control device 22 stores the lookup table (lateral thrust conversion table) defining the relationship between the turning ratio and the amplification factor (gain) of the lateral thrust, but may store a mathematical equation corresponding to the graph GR4 described with reference to FIG. 13.

Third Embodiment

Hereinafter, a third embodiment of the present invention will be described with reference to FIGS. 15 to 18. Note that contents different from those in the first and second embodiments will be described, and description of the same contents as those in the first and second embodiments will be omitted. The third embodiment is different from the first and second embodiments in that offset bow azimuth information is input from the route setting device 11 to the route following control device 31. In addition, in the third embodiment, the ship 1 is a ship other than a single-screw propulsion type ship. In other words, the ship 1 is a ship capable of making oblique sailing and pivot turn.

Figure 15:
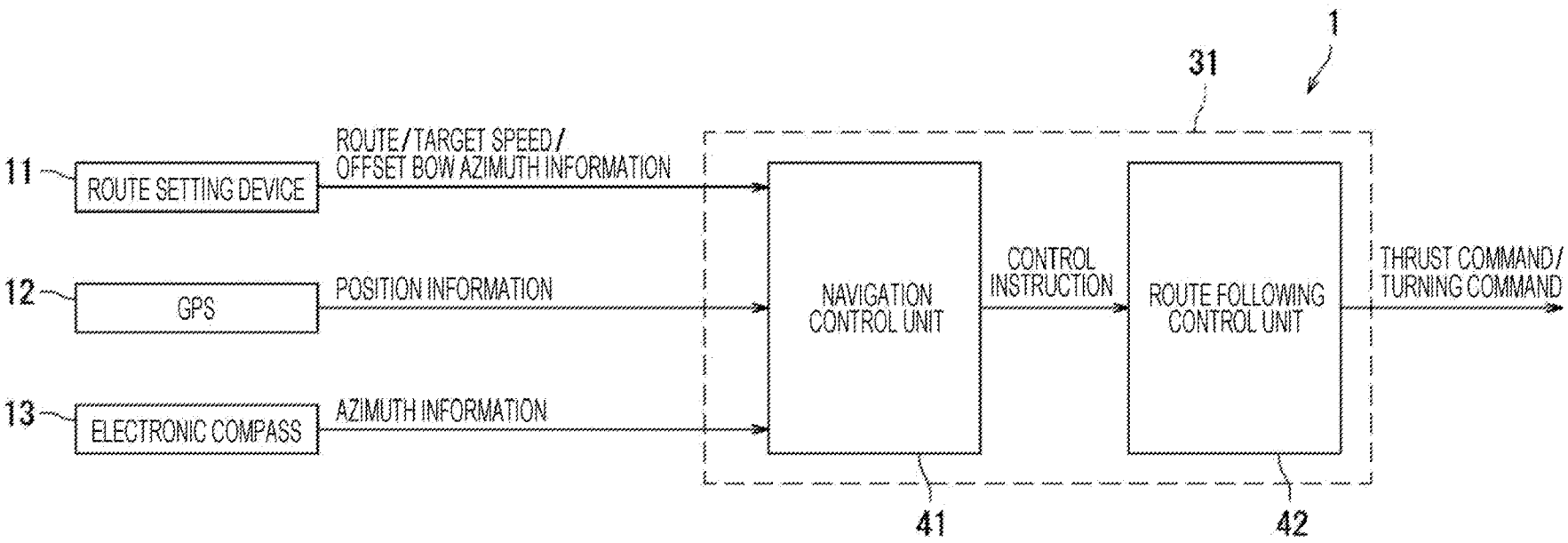
FIG. 15 is a block diagram illustrating part of the configuration of a ship according to a third embodiment of the present invention.

FIG. 15 is a block diagram illustrating part of the configuration of the ship 1 of the present embodiment. As illustrated in FIG. 15, in the present embodiment, the route setting device 11 further outputs the offset bow azimuth information to the route following control device 31. The offset bow azimuth information indicates an offset bow azimuth. In the present embodiment, the offset bow azimuth is one example of a scheduled bow azimuth.

Specifically, the route setting device 11 receives the setting of the offset bow azimuth. Thus, the ship operator can set the offset bow azimuth by performing touch operation on the touch display 11*a* of the route setting device 11. The offset bow azimuth is, for example, a bow azimuth desired by the ship operator.

Specifically, the offset bow azimuth can be set at an arbitrary position on the scheduled course. Moreover, the offset bow azimuth can be set at a plurality of positions. For example, the offset bow azimuth can be set at a position before the course change position on the scheduled course.

Figure 16:
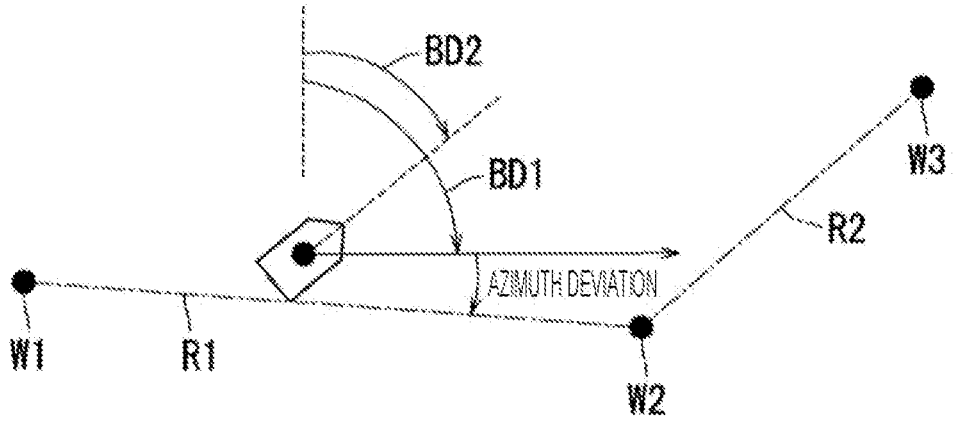
FIG. 16 is a view illustrating a relationship between an actual bow azimuth and an offset bow azimuth.

FIG. 16 is a view illustrating a relationship between an actual bow azimuth BD1 and an offset bow azimuth BD2. In FIG. 16, the ship 1 follows a straight first scheduled route line R1 from a first transit point W1 to a second transit point W2, and thereafter, follows a straight second scheduled route line R2 from the second transit point W2 to a third transit point W3. The second transit point W2 is the course change position, and the course of the ship 1 changes at the second transit point W2.

The offset bow azimuth BD2 is such a bow azimuth that the azimuth deviation from the next scheduled route line is smaller than the azimuth deviation from the current scheduled route line. In the example illustrated in FIG. 16, the azimuth deviation between the offset bow azimuth BD2 and the first scheduled route line R1 (current scheduled route line) is greater than the azimuth deviation between the actual bow azimuth BD1 and the first scheduled route line R1 (current scheduled route line). However, the azimuth deviation between the offset bow azimuth BD2 and the second scheduled route line R2 (next scheduled route line) is smaller than the azimuth deviation between the actual bow azimuth BD1 and the second scheduled route line R2 (next scheduled route line).

Figure 17:
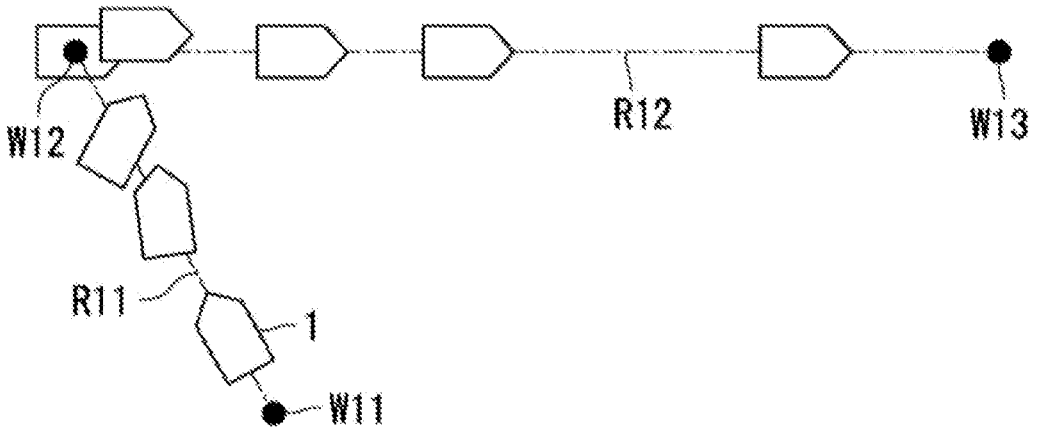
FIG. 17 is a view illustrating one example of movement of the ship according to the third embodiment of the present invention.

Subsequently, one example of movement at the time of changing the course of the ship 1 will be described with reference to FIG. 17. FIG. 17 is a view illustrating one example of movement of the ship 1 of the present embodiment. Specifically, FIG. 17 illustrates movement of the ship 1 when the automatic mode is valid. In FIG. 17, the ship 1 follows a straight first scheduled route line R11 from a first transit point W11 to a second transit point W12, and thereafter, follows a straight second scheduled route line R12 from the second transit point W12 to a third transit point W13. The second transit point W12 is the course change position, and the course of the ship 1 changes at the second transit point W12.

In the example illustrated in FIG. 17, the offset bow azimuth is set at a position before the second transit point W12 (course change position). Thus, before the ship 1 reaches the second transit point W12 (course change position), the ship 1 turns round such that the bow azimuth of the ship 1 changes to an azimuth close to the azimuth of the next scheduled route line (second scheduled route line R12). As a result, it is possible to further decrease the turning radius when the course of the ship 1 is changed at the second transit point W12 (course change position).

Figure 18:
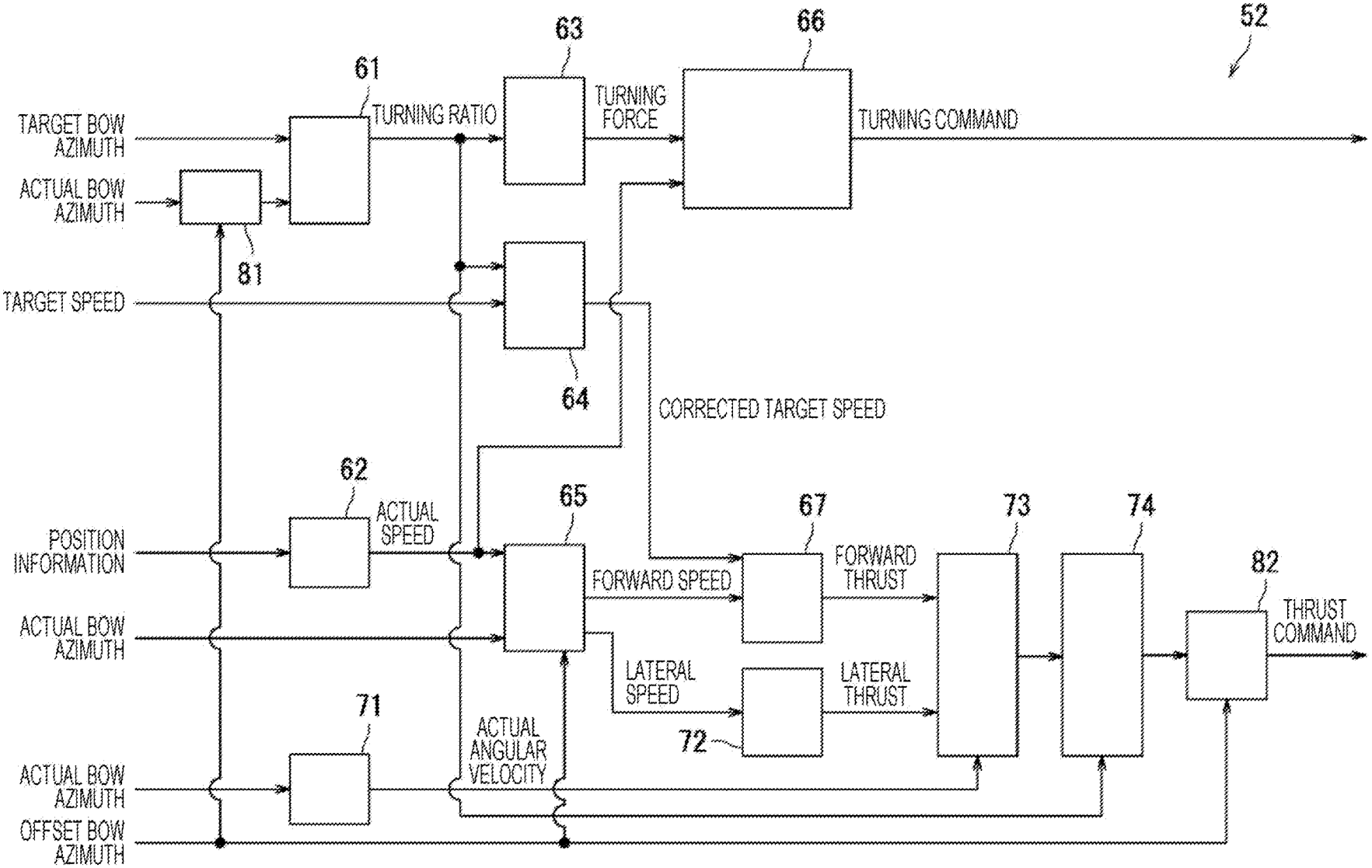
FIG. 18 is a block diagram illustrating the configuration of an azimuth-speed control unit of a route following control device according to the third embodiment of the present invention.

Subsequently, the azimuth-speed control unit 52 will be described with reference to FIG. 18. FIG. 18 is a block diagram illustrating the configuration of the azimuth-speed control unit 52 of the route following control device 31 of the present embodiment. As illustrated in FIG. 18, the azimuth-speed control unit 52 further includes a first offset processing unit 81 and a second offset processing unit 82.

The first offset processing unit 81 is arranged at a stage before the azimuth deviation acquisition unit 61 to replace the actual bow azimuth with the offset bow azimuth. Thus, the azimuth deviation acquisition unit 61 sets the turning ratio based on the azimuth deviation between the target bow azimuth and the offset bow azimuth.

When acquiring a speed component (forward speed) in the bow direction and a lateral speed component from the actual speed vector, the coordinate conversion unit 65 acquires a speed component (forward speed) of the offset bow azimuth and a speed component (lateral speed component) in a direction orthogonal to the offset bow azimuth.

The second offset processing unit 82 replaces the thrust direction of the forward thrust with the offset bow azimuth. In addition, in a case where the thrust command includes a lateral thrust command, the second offset processing unit 82 replaces the thrust direction of the lateral thrust with the direction orthogonal to the offset bow azimuth.

According to the azimuth-speed control unit 52 described with reference to FIG. 18, it is possible to turn the ship 1 round such that the azimuth deviation from the next scheduled route line decreases before the course change position. That is, the bow azimuth can be adjusted to the azimuth of the next scheduled route line before the course change position.

The third embodiment of the present invention has been described above with reference to FIGS. 15 to 18. According to the present embodiment, the bow azimuth can be adjusted to the azimuth of the next scheduled route line before the course change position. Thus, the turning radius can be further decreased.

Fourth Embodiment

Hereinafter, a fourth embodiment of the present invention will be described with reference to FIG. 19. Note that contents different from those in the first to third embodiments will be described, and description of the same contents as those in the first to third embodiments will be omitted. The fourth embodiment is different from the first to third embodiments in that the route setting device 11 does not generate the target speed information.

Figure 19:
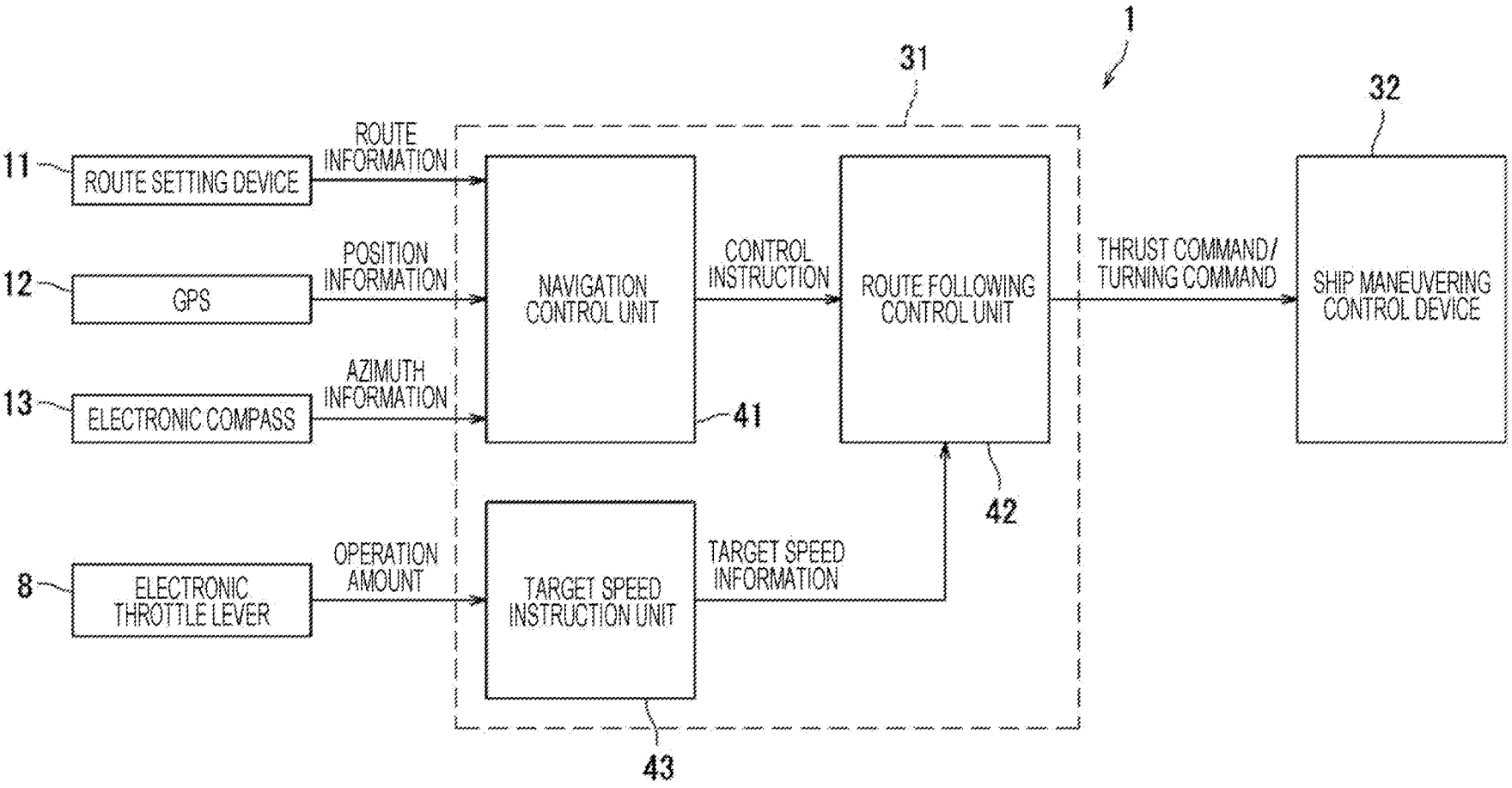
FIG. 19 is a block diagram illustrating part of the configuration of a ship according to a fourth embodiment of the present invention.

FIG. 19 is a block diagram illustrating part of the configuration of the ship 1 of the present embodiment. As illustrated in FIG. 19, in the present embodiment, the route following control device 31 further includes a target speed instruction unit 43.

The target speed instruction unit 43 sets the target speed according to the operation amount (or the operation position) of the electronic throttle lever 8. Specifically, when the right throttle lever or the left throttle lever is operated by the ship operator, the electronic throttle lever 8 outputs, to the control device 22, a signal indicating the operation amount (or operation position) of the right throttle lever or the left throttle lever. When the automatic mode is valid, the target speed instruction unit 43 sets the target speed based on the signal output from the electronic throttle lever 8, and outputs the target speed information to the route following control unit 42.

The fourth embodiment of the present invention has been described above with reference to FIG. 19. According to the present embodiment, the ship operator can set the target speed by operating the electronic throttle lever 8.

Fifth Embodiment

Hereinafter, a fifth embodiment of the present invention will be described with reference to FIGS. 20 to 24. Note that contents different from those in the first to fourth embodiments will be described, and description of the same contents as those in the first to fourth embodiments will be omitted. The fifth embodiment is different from the first to fourth embodiments in that the thrust command is generated without using the target speed information.

Figure 20:
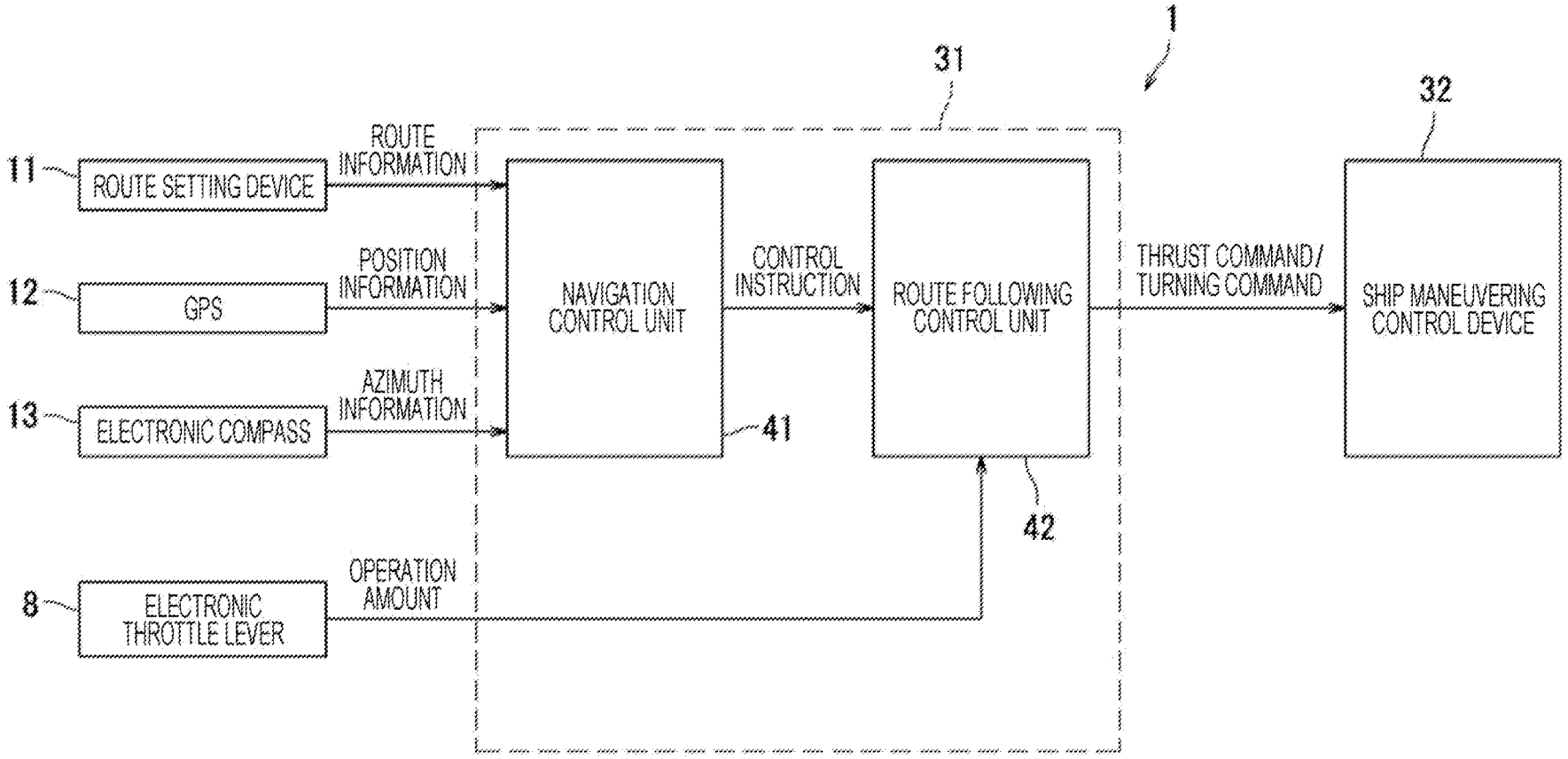
FIG. 20 is a block diagram illustrating part of the configuration of a ship according to a fifth embodiment of the present invention.

FIG. 20 is a block diagram illustrating part of the configuration of the ship 1 of the present embodiment. As illustrated in FIG. 5, in the present embodiment, the signal indicating the operation amount (or operation position) of the right throttle lever or left throttle lever of the electronic throttle lever 8 is input to the route following control unit 42. Hereinafter, the operation amount (or operation amount) of the right throttle lever or left throttle lever of the electronic throttle lever 8 may be referred to as an "operation amount of the electronic throttle lever 8."

Figure 21:
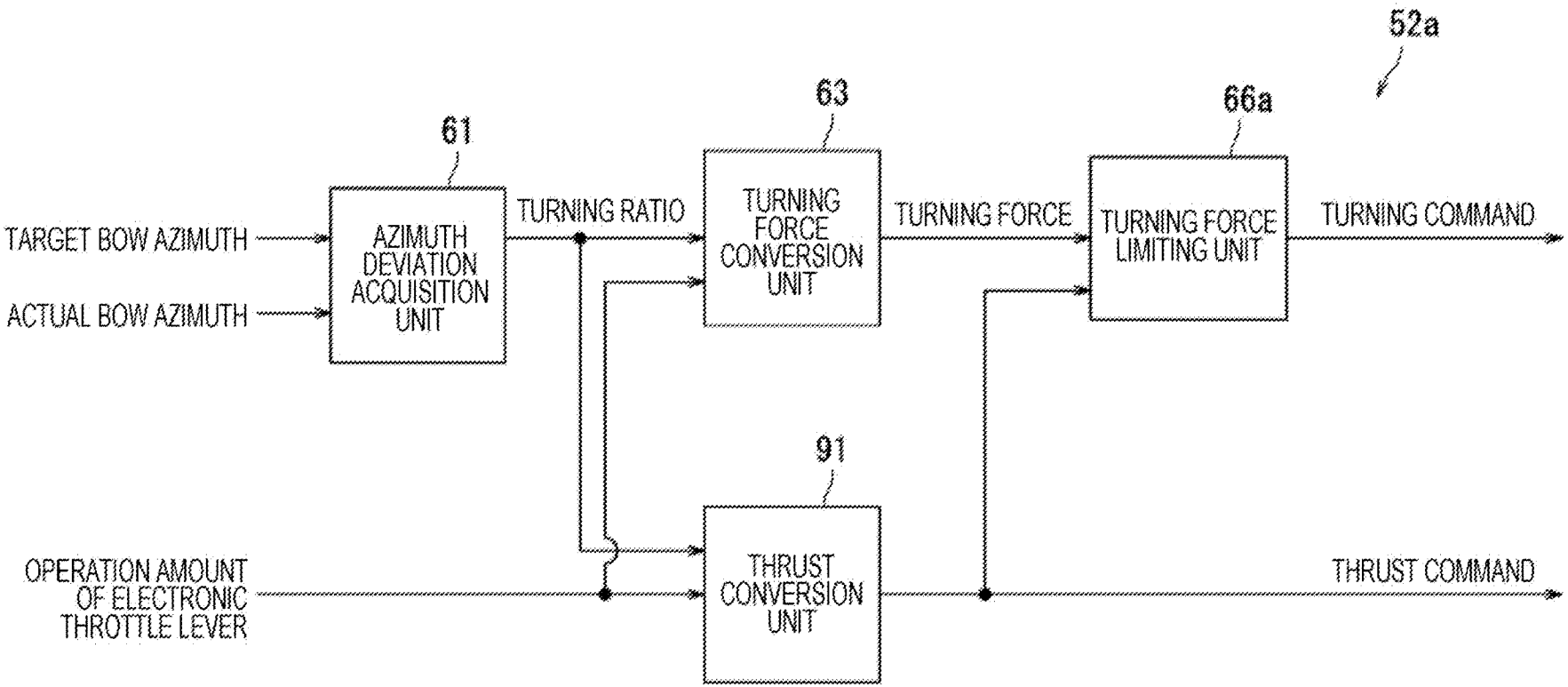
FIG. 21 is a block diagram illustrating the configuration of an azimuth control unit included in a route following control device according to the fifth embodiment of the present invention.

Subsequently, an azimuth control unit 52*a* included in the route following control device 31 in the present embodiment will be described with reference to FIG. 21. FIG. 21 is a block diagram illustrating the configuration of the azimuth control unit 52*a* included in the route following control device 31 of the present embodiment. In the present embodiment, the route following control unit 42 (see FIG. 6) includes the azimuth control unit 52*a* instead of the azimuth-speed control unit 52. That is, the route following control device 31 (ship maneuvering device) of the present embodiment does not include a speed control system.

As illustrated in FIG. 21, the azimuth control unit 52*a* includes the azimuth deviation acquisition unit 61, the turning force conversion unit 63, a turning force limiting unit 66*a*, and a thrust conversion unit 91. The signal indicating the operation amount of the electronic throttle lever 8 described with reference to FIG. 20 is input to the turning force conversion unit 63 and the thrust conversion unit 91.

The thrust conversion unit 91 generates the thrust command based on the operation amount of the electronic throttle lever 8 and the turning ratio. Specifically, the control device 22 stores a first turning ratio conversion table (lookup table) for each of a plurality of operation amounts (or operation positions) of the electronic throttle lever 8. The first turning ratio conversion table defines the relationship between the turning ratio and the forward thrust such that the forward thrust decreases as the turning ratio increases in the range in which the turning ratio is the threshold th or more. The thrust conversion unit 91 selects one of the first turning ratio conversion tables based on the operation amount of the electronic throttle lever 8. Then, the forward thrust is acquired from the turning ratio with reference to the selected first turning ratio conversion table.

According to the present embodiment, the forward thrust decreases as the turning ratio increases in the range in which the turning ratio is the threshold th or more. Thus, even in a configuration in which the route following control device 31 (ship maneuvering device) does not include the speed control system, it is possible to decrease the turning radius when the course of the ship 1 is changed.

The turning force conversion unit 63 sets the turning force based on the operation amount of the electronic throttle lever 8 and the turning ratio. Specifically, the control device 22 stores a second turning ratio conversion table (lookup table) for each of the plurality of operation amounts (or operation positions) of the electronic throttle lever 8. The second turning ratio conversion table defines the relationship between the turning ratio and the turning force such that the turning force increases as the turning ratio increases. The turning force conversion unit 63 selects one of the second turning ratio conversion tables based on the operation amount of the electronic throttle lever 8. Then, the turning force is acquired from the turning ratio with reference to the selected second turning ratio conversion table.

The turning force limiting unit 66*a* restricts the turning force based on the forward thrust set by the thrust conversion unit 91. Specifically, the turning force limiting unit 66*a* sets the upper limit of the turning force according to the forward thrust. In a case where the turning force set by the turning force conversion unit 63 does not exceed the upper limit, the turning force limiting unit 66*a* outputs the turning command indicating the turning force set by the turning force conversion unit 63. On the other hand, in a case where the turning force set by the turning force conversion unit 63 is the upper limit or more, the turning command indicating the upper limit is output.

According to the present embodiment, since the turning force can be restricted based on the forward thrust, it is possible to avoid outward rolling of the ship 1 due to the turning force at the time of changing the course.

Subsequently, a relationship among the operation amount of the electronic throttle lever 8, the forward thrust, and the turning force will be described with reference to FIGS. 22 to 24. First, with reference to FIG. 22, the forward thrust and the turning force when the operation amount of the electronic throttle lever 8 is 0% will be described.

Figure 22:
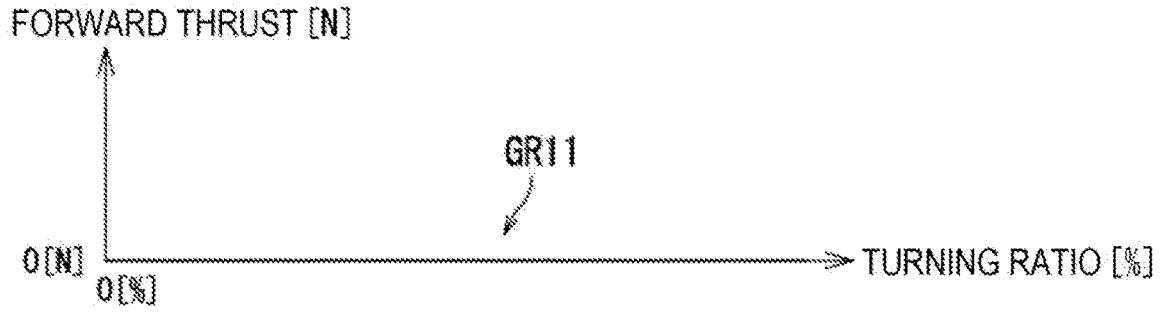
FIG. 22(*a*) is a graph defining the relationship between the turning ratio and the degree of forward thrust when the operation amount of an electronic throttle lever is 0%.
Figure 22:
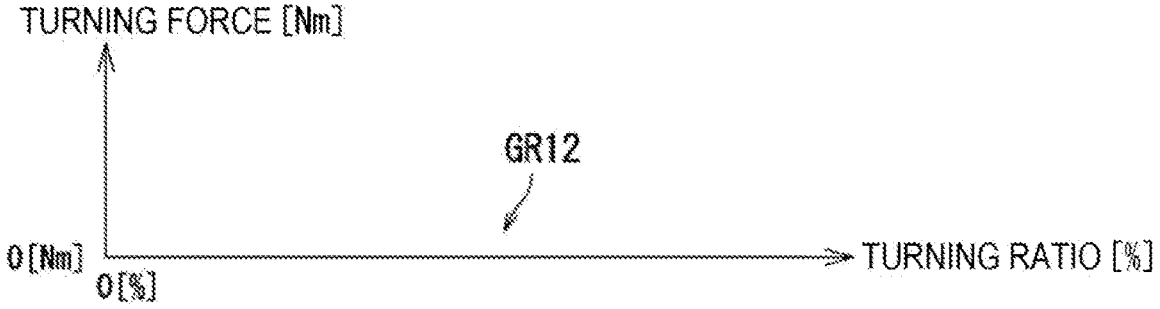
Figure 22:
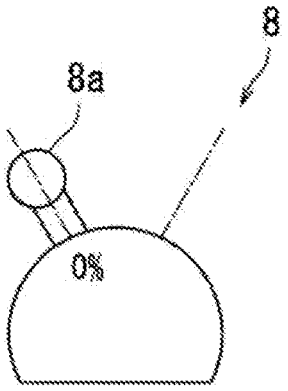

FIG. 22(*a*) is a graph GR11 defining a relationship between the turning ratio and the degree of forward thrust when the operation amount of the electronic throttle lever 8 is 0%. FIG. 22(*b*) is a graph GR12 defining a relationship between the turning ratio and the degree of turning force when the operation amount of the electronic throttle lever 8 is 0%. FIG. 22(*c*) is a view schematically illustrating the operation amount of the electronic throttle lever 8. In FIG. 22(*a*), the vertical axis indicates the degree of forward thrust. In FIG. 22(*b*), the vertical axis indicates the degree of turning force. FIG. 22(*c*) illustrates that the operation amount of a throttle lever 8*a* (right throttle lever or left throttle lever) of the electronic throttle lever 8 is 0%.

As illustrated in FIG. 22(*a*), the graph GR11 is defined as 0 [N]. The control device 22 stores the first turning ratio conversion table corresponding to the graph GR11. In a case where the operation amount of the electronic throttle lever 8 is 0%, the thrust conversion unit 91 refers to the first turning ratio conversion table corresponding to the graph GR11 to set the forward thrust to 0 [N].

As illustrated in FIG. 22(*b*), the graph GR12 is defined as 0 [Nm]. The control device 22 stores the second turning ratio conversion table corresponding to the graph GR12. In a case where the operation amount of the electronic throttle lever 8 is 0%, the turning force conversion unit 63 refers to the second turning ratio conversion table corresponding to the graph GR12 to set the turning force to 0 [Nm].

Subsequently, with reference to FIG. 23, the forward thrust and the turning force when the operation amount of the electronic throttle lever 8 is 50% will be described. FIG. 23(*a*) is a graph GR21 defining the relationship between the turning ratio and the degree of forward thrust when the operation amount of the electronic throttle lever 8 is 50%. FIG. 23(*b*) is a graph GR22 defining the relationship between the turning ratio and the degree of turning force when the operation amount of the electronic throttle lever 8 is 50%. FIG. 23(*c*) is a view schematically illustrating the operation amount of the electronic throttle lever 8. In FIG. 23(*a*), the vertical axis indicates the degree of forward thrust. In FIG. 23(*b*), the vertical axis indicates the degree of turning force. FIG. 23(*c*) illustrates that the operation amount of the throttle lever 8*a* of the electronic throttle lever 8 is 50%.

Figure 23:
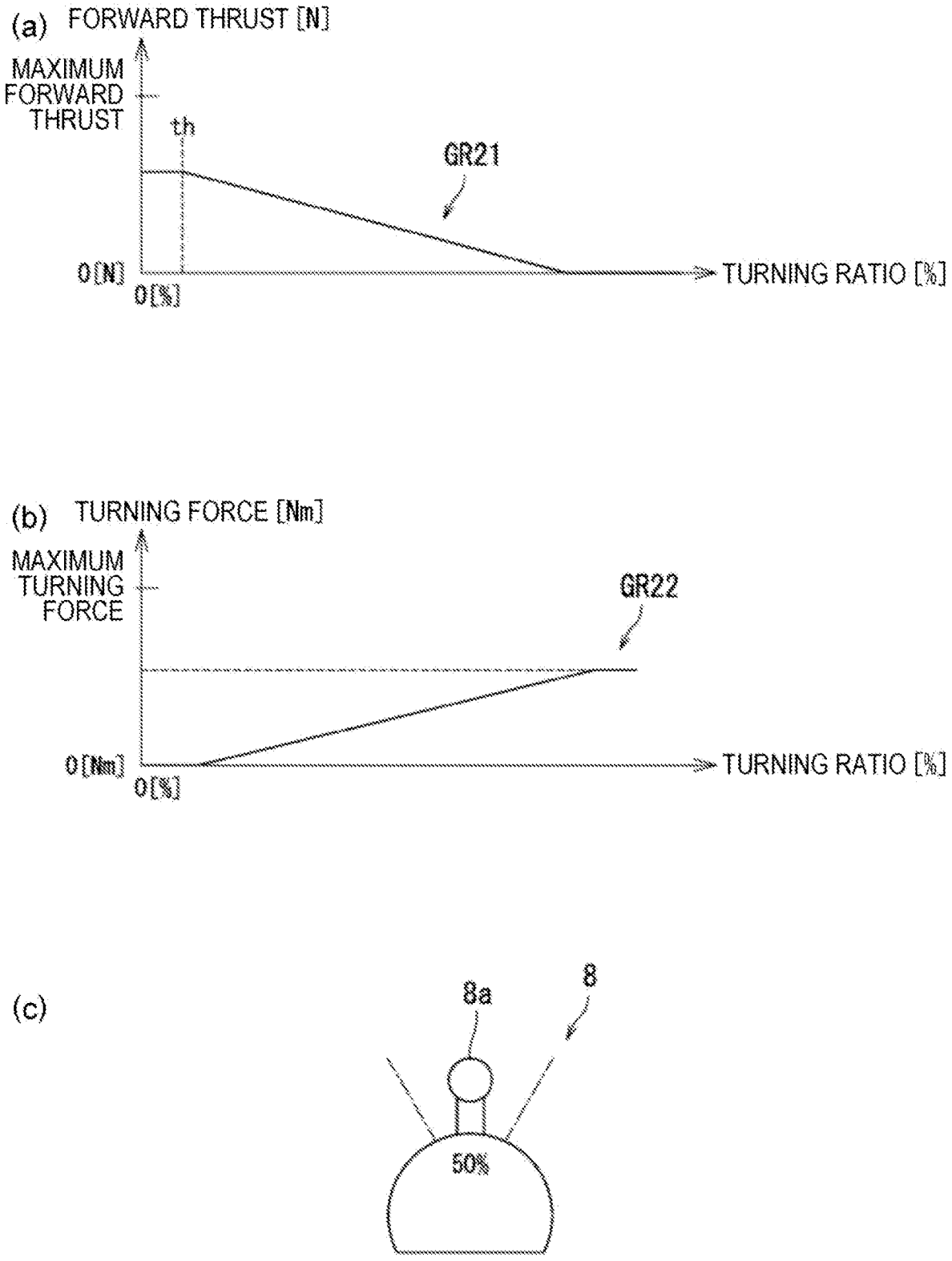
FIG. 23(*a*) is a graph defining the relationship between the turning ratio and the degree of forward thrust when the operation amount of the electronic throttle lever is 50%.

As illustrated in FIG. 23(*a*), the graph GR21 is defined such that the forward thrust decreases as the turning ratio increases in the range in which the turning ratio is the threshold th or more. Specifically, the graph GR21 is defined such that the forward thrust decreases as the turning ratio increases in a range of 50% of the maximum forward thrust or less. Thus, the maximum value of the graph GR21 indicates the value of 50% of the maximum forward thrust. That is, in a case where the operation amount of the electronic throttle lever 8 is 50%, the maximum value of the forward thrust is 50% of the maximum forward thrust.

The control device 22 stores the first turning ratio conversion table corresponding to the graph GR21. In a case where the operation amount of the electronic throttle lever 8 is 50%, the thrust conversion unit 91 refers to the first turning ratio conversion table corresponding to the graph GR21 to acquire the forward thrust from the turning ratio.

As illustrated in FIG. 23(*b*), the graph GR22 is defined such that the turning force increases as the turning ratio increases. Specifically, the graph GR22 is defined such that the turning force increases as the turning ratio increases in a range of 50% of the maximum turning force or less. Thus, the maximum value of the graph GR22 indicates the value of 50% of the maximum turning force. That is, in a case where the operation amount of the electronic throttle lever 8 is 50%, the maximum value of the turning force is 50% of the maximum turning force.

The control device 22 stores the second turning ratio conversion table corresponding to the graph GR22. In a case where the operation amount of the electronic throttle lever 8 is 50%, the turning force conversion unit 63 refers to the second turning ratio conversion table corresponding to the graph GR22 to acquire the turning force from the turning ratio.

Subsequently, with reference to FIG. 24, the forward thrust and the turning force when the operation amount of the electronic throttle lever 8 is 100% will be described. FIG. 24(*a*) is a graph GR31 defining the relationship between the turning ratio and the degree of forward thrust when the operation amount of the electronic throttle lever 8 is 100%. FIG. 24(*b*) is a graph GR32 defining the relationship between the turning ratio and the degree of turning force when the operation amount of the electronic throttle lever 8 is 100%. FIG. 24(*c*) is a view schematically illustrating the operation amount of the electronic throttle lever 8. In FIG. 24(*a*), the vertical axis indicates the degree of forward thrust. In FIG. 24(*b*), the vertical axis indicates the degree of turning force. FIG. 24(*c*) illustrates that the operation amount of the throttle lever 8*a* of the electronic throttle lever 8 is 100%.

Figure 24:
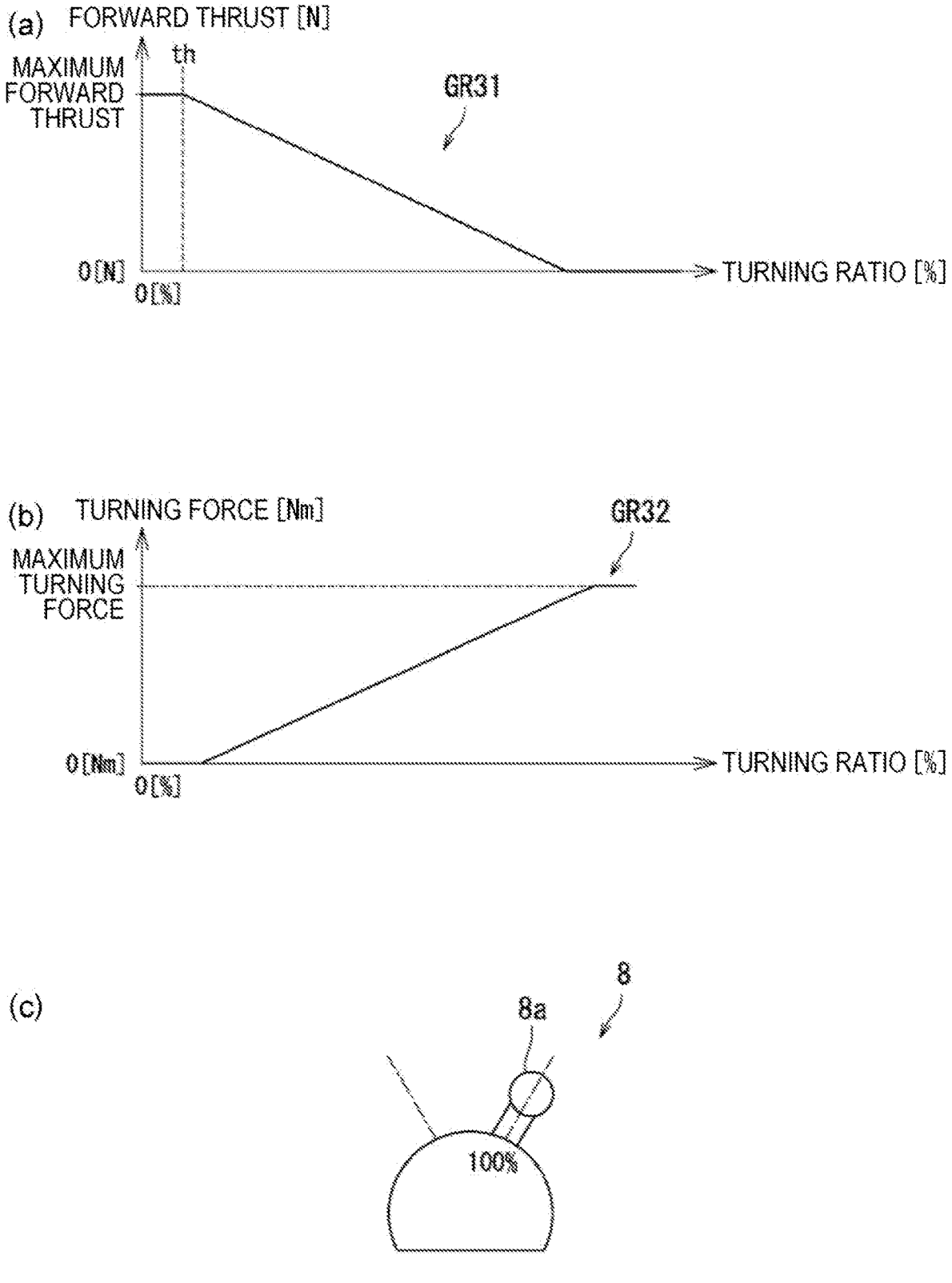
FIG. 24(*a*) is a graph defining the relationship between the turning ratio and the degree of forward thrust when the operation amount of the electronic throttle lever is 100%.

As illustrated in FIG. 24(*a*), the graph GR31 is defined such that the forward thrust decreases as the turning ratio increases in the range in which the turning ratio is the threshold th or more. Specifically, the graph GR31 is defined such that the forward thrust decreases as the turning ratio increases in a range of the maximum forward thrust or less. Thus, the maximum value of the graph GR31 indicates the maximum forward thrust. That is, in a case where the operation amount of the electronic throttle lever 8 is 100%, the maximum value of the forward thrust is the maximum forward thrust.

The control device 22 stores the first turning ratio conversion table corresponding to the graph GR31. In a case where the operation amount of the electronic throttle lever 8 is 100%, the thrust conversion unit 91 refers to the first turning ratio conversion table corresponding to the graph GR31 to acquire the forward thrust from the turning ratio.

As illustrated in FIG. 24(*b*), the graph GR32 is defined such that the turning force increases as the turning ratio increases. Specifically, the graph GR32 is defined such that the turning force increases as the turning ratio increases in a range of the maximum turning force or less. Thus, the maximum value of the graph GR32 indicates the maximum turning force. That is, in a case where the operation amount of the electronic throttle lever 8 is 100%, the maximum value of the turning force is the maximum turning force.

The control device 22 stores the second turning ratio conversion table corresponding to the graph GR32. In a case where the operation amount of the electronic throttle lever 8 is 100%, the turning force conversion unit 63 refers to the second turning ratio conversion table corresponding to the graph GR32 to acquire the turning force from the turning ratio.

The embodiments of the present invention have been described above with reference to the drawings (FIGS. 1 to 24). Note that the present invention is not limited to the above-described embodiments and can be implemented in various aspects without departing from the gist of the present invention. In addition, the plurality of components disclosed above in the embodiments can be modified as necessary. For example, some of all the components described in one embodiment may be added to components of another embodiment, or some components of all the components described in one embodiment may be omitted from the embodiment.

The drawings schematically illustrate each component mainly for the sake of easy understanding of the invention, and the thickness, length, number, interval, etc. of each component illustrated may be different from actual ones for the sake of convenience in drawing creation. In addition, the configuration of each component described above in the embodiments is one example and is not particularly limited, and needless to say, various changes can be made without substantially departing from the effects of the present invention.

For example, the navigation control unit 41 may decrease the target speed when the ship 1 approaches the course change position. In this case, the target speed correction unit 64 corrects the target speed changed by the navigation control unit 41.

In the embodiments described with reference to FIGS. 1 to 24, the notification screen G is displayed on the touch display 11*a*, but the control device 22 may display the notification screen G on another indicator mounted on the ship 1.

In the embodiments described with reference to FIGS. 1 to 24, the twin-screw propulsion type shaft ship including one side thruster is exemplified as the ship capable of making oblique sailing and pivot turn. However, the ship capable of making oblique sailing and pivot turn is not limited to the twin-screw propulsion type shaft ship including one side thruster. For example, the ship 1 may be a ship equipped with two stern drive devices (inboard-outdrive engines), a ship equipped with two outboard engines, a ship equipped with two water jets, a single-screw propulsion type shaft ship equipped with two side thrusters, a ship equipped with two pot drives, a ship equipped with two azimuth thrusters, a ship equipped with two Z-pellers, or a ship equipped with two Voigth Schneider propellers. Alternatively, the ship 1 may include three or more thrusters (propulsion devices), the thrust directions of which are variable, or four or more thrusters (propulsion devices), the thrust directions of which are fixed.

In the embodiments described with reference to FIGS. 1 to 24, the azimuth-speed control unit 52 and the azimuth control unit 52*a* control the forward thrust and the turning force based on the turning ratio, but may control the forward thrust and the turning force based on the azimuth deviation between the target bow azimuth and the actual bow azimuth. For example, the azimuth-speed control unit 52 may set the turning force based on the azimuth deviation between the target bow azimuth and the actual bow azimuth, and correct the target speed based on the set turning force. Alternatively, the azimuth-speed control unit 52 may set the rudder angle based on the azimuth deviation between the target bow azimuth and the actual bow azimuth, and correct the target speed based on the set rudder angle. Similarly, the azimuth control unit 52*a* may set the turning force based on the azimuth deviation between the target bow azimuth and the actual bow azimuth, and correct the forward thrust based on the set turning force. Alternatively, the azimuth control unit 52*a* may set the rudder angle based on the azimuth deviation between the target bow azimuth and the actual bow azimuth, and correct the forward thrust based on the set rudder angle.

In the embodiments described with reference to FIGS. 1 to 24, the lateral thrust limiting unit 74 corrects the lateral thrust based on the turning ratio, but may correct the lateral thrust based on the azimuth deviation between the target bow azimuth and the actual bow azimuth.

In the embodiments described with reference to FIGS. 1 to 19, the target value of the parameter related to the thrust of the ship 1 is the target speed, but is not limited to the target speed. The target value of the parameter related to the thrust of the ship 1 may be, for example, a target thrust, a target engine speed, or a target throttle opening degree value. In this case, the azimuth-speed control unit 52 corrects the target thrust, the target engine speed, or the target throttle opening degree value based on the turning ratio. Alternatively, the azimuth-speed control unit 52 may correct the target thrust, the target engine speed, or the target throttle opening degree value based on the azimuth deviation between the target bow azimuth and the actual bow azimuth.

INDUSTRIAL APPLICABILITY

The present invention is useful for autopilot of a ship.

LIST OF REFERENCE SIGNS

1 Ship
11 Route Setting Device
11*a* Touch Display
21*a* First Propulsion Device
21*b* Second Propulsion Device
21*c* Third Propulsion Device
22 Control Device
31 Route Following Control Device

32 Ship Maneuvering Control Device
33 Thrust Distribution Device
41 Navigation Control Unit
42 Route Following Control Unit
43 Target Speed Instruction Unit
51 Course Control Unit
52 Speed Control Unit
61 Azimuth Deviation Acquisition Unit
62 Actual Speed Computing Unit
63 Turning Force Conversion Unit
64 Target Speed Correction Unit
65 Coordinate Conversion Unit
66 Turning Force Limiting Unit
67 Forward Speed Control Unit
71 Actual Angular Velocity Computing Unit
72 Lateral Speed Control Unit
73 Azimuth Correction Unit
74 Lateral Thrust Limiting Unit
81 First Offset Processing Unit
82 Second Offset Processing Unit

The invention claimed is:

1. A ship maneuvering device for moving a ship equipped with at least one propulsion device along a scheduled course, the ship maneuvering device comprising:

a control unit configured to acquire an azimuth deviation between an actual bow azimuth which is a current bow azimuth of the ship and a target bow azimuth of the ship to generate a thrust command indicating thrust for propelling the ship based on the azimuth deviation, and wherein, in a case where the azimuth deviation is greater than or equal to a predetermined value, the control unit is configured to generate the thrust command such that a speed of the ship decreases from an actual speed which is a current speed of the ship.

2. The ship maneuvering device according to claim 1, wherein the control unit is further configured to:

generate a turning command indicating a turning force for turning the ship based on the azimuth deviation, and restrict the turning force based on the actual speed.

3. The ship maneuvering device according to claim 1, wherein the control unit is configured to:

correct a target value of a parameter related to the thrust of the ship based on the azimuth deviation such that the speed of the ship decreases from the actual speed, and generate the thrust command based on the corrected target value.

4. The ship maneuvering device according to claim 3, wherein:

the target value is a target speed, and the control unit is further configured to:

acquire, from the actual speed, a forward speed which is a speed component of the actual bow azimuth, acquire first thrust for propelling the ship to the actual bow azimuth based on the corrected target speed and the forward speed, and generate the thrust command based on the first thrust.

5. The ship maneuvering device according to claim 4, wherein;

the ship is mounted with a plurality of propulsion devices, and the control unit is further configured to:

acquire, from the actual speed, a lateral speed which is a speed component in a lateral direction orthogonal to the actual bow azimuth, acquire second thrust making the lateral speed zero, and generate the thrust command based on the first thrust and the second thrust.

6. The ship maneuvering device according to claim 5, wherein an azimuth to which the first thrust is generated and an azimuth to which the second thrust is generated are corrected based on an actual angular velocity which is a current angular velocity of the ship.

7. The ship maneuvering device according to claim 5, wherein the control unit is further configured to correct the second thrust based on the azimuth deviation.

8. The ship maneuvering device according to claim 5, wherein the control unit is further configured to set the second thrust to zero based on the azimuth deviation.

9. The ship maneuvering device according to claim 5, wherein the control unit is further configured to:

replace the actual bow azimuth with a scheduled bow azimuth, acquire the azimuth deviation, the forward speed, and the lateral speed based on the scheduled bow azimuth, and replace an azimuth of the thrust indicated by the thrust command with the scheduled bow azimuth.

10. A ship comprising:

at least one propulsion device; and the ship maneuvering device according to claim 1, and wherein the at least one propulsion device is configured to operate based on at least the thrust command.

11. A ship comprising:

a plurality of propulsion devices;

the ship maneuvering device according to claim 5; and a thrust distribution device that is configured to control the plurality of propulsion devices based on at least the thrust command.

12. The ship according to claim 10, further comprising:

an indicator, and wherein:

the control unit of the ship maneuvering device is configured to acquire a turning ratio indicating a ratio between thrust for propelling the ship to the actual bow azimuth and turning force for turning the ship based on the azimuth deviation, and the indicator is configured to display a screen showing the turning ratio.

* * * * *